US005905234A

United States Patent [19]

Tsukamoto et al.

[11] Patent Number: 5,905,234

[45] Date of Patent: May 18, 1999

[54] SOUND ABSORBING MECHANISM USING A POROUS MATERIAL

[75] Inventors: Kouji Tsukamoto; Katsuhisa Ootsuta; Shuichi Tani, all of Hyogo; Masayuki Kurashina, Tokyo; Toshihisa Imai, Saitama, all of Japan

[73] Assignees: Mitsubishi Electric Home Appliance Co., Ltd., Saitama; Mitsubishi Denki Kabushiki Kaisha, Tokyo, both of Japan

[21] Appl. No.: 08/492,550

[22] Filed: Jun. 20, 1995

[30] Foreign Application Priority Data

Aug. 31, 1994 [JP] Japan ..... 6-206919

[51] Int. Cl.[6] ..... E04B 1/82

[52] U.S. Cl. ..... 181/286; 181/292

[58] Field of Search ..... 181/286, 288, 181/290, 291, 292, 294, 295, 210

[56] References Cited

U.S. PATENT DOCUMENTS

| | | | |
|---|---|---|---|
| 3,182,747 | 5/1965 | Wilhelmi et al. | 181/292 |
| 3,578,105 | 5/1971 | Griff . | |
| 3,831,710 | 8/1974 | Wirt | 181/292 |
| 3,887,031 | 6/1975 | Wirt . | |
| 4,253,543 | 3/1981 | Johansson . | |
| 4,821,841 | 4/1989 | Woodward et al. . | |
| 5,108,833 | 4/1992 | Noguchi et al. . | |
| 5,110,258 | 5/1992 | Morinushi et al. . | |
| 5,117,939 | 6/1992 | Noguchi et al. . | |
| 5,317,113 | 5/1994 | Duda . | |

FOREIGN PATENT DOCUMENTS

| | | |
|---|---|---|
| 0 046 559 | 3/1982 | European Pat. Off. . |
| 0 246 464 | 11/1987 | European Pat. Off. . |
| 0 680 031 | 11/1994 | European Pat. Off. . |
| 1 029 433 | 10/1958 | Germany . |
| 43 12 885 | 10/1994 | Germany . |
| 4-76117 | 12/1992 | Japan . |
| 578 657 | 8/1976 | Switzerland . |
| 2 005 384 | 4/1979 | United Kingdom . |

OTHER PUBLICATIONS

*Kenchiku Onkyo Kogaku Hando Bukku* (*Architectural Acoustics Handbook*) ed. by Nippon Onkyo Zairyo Kyokai (Japan Acoustical Materials Association), Gihodo, Tokyo, 1963.

*Patent Abstracts of Japan,* p–1714, p. 3, JP–333866, Dec. 17, 1993.

*Primary Examiner*—Khanh Dang

*Attorney, Agent, or Firm*—Burns, Doane, Swecker & Mathis, L.L.P.

[57] ABSTRACT

A sound absorbing mechanism using a porous material has a sound absorbing plate of a thin plate porous material made by partially heating for welding plastic particles and a supporting member for supporting the sound absorbing plate and forming a back air space. More than one pair of resonators having a separated back air space in the aforementioned back air space are fixed to the sound absorbing plate, and the resonators are disposed to be opposed to a sound insulator with the supporting member between. Plural reflecting members or increased sound absorbers may be disposed to be opposed to the surface of the sound absorbing plate opposite to the surface equipped with the resonators, or a perforated protecting plate fixing the plural reflecting members or the increased sound absorbers thereon are may be equipped. The sound absorbing mechanism has a superior sound absorption characteristic from lower frequencies to higher frequencies.

9 Claims, 28 Drawing Sheets

POROUS MATERIALS

① ROCK WOOL LATH-APPLIED FELT t = 25

② CEMENTED EXCELSIOR BOARD t = 12

③ NO BACKING MATERIAL

SOUND ABSORBING MECHANISM USING A POROUS MATERIAL

BACKGROUND OF THE INVENTION

1. Field of the Invention

This invention relates to an improvement of a sound absorbing mechanism to be placed around a noise generating source or in a propagation path of a noise, and more particularly relates to a sound absorbing mechanism using a porous material.

2. Description of the Prior Art

Prior Art 1

FIG. 44 is a sectional view showing the construction of a conventional sound absorbing mechanism using a hard porous material as a first prior art (prior art 1), and the figure also has an explanatory diagram for showing a sound pressure distribution of a sound wave to be input into the sound absorbing plate thereof. In FIG. 44, reference numeral 1 designates a sound insulator such as a wall: and numeral 2 designates a sound absorbing plate of a hard porous material made of plastic particles, a ceramic, foam metal or the like, for example. Reference numeral 11 designates a back air space of the sound absorbing plate 2; numeral 11*a* designates the thickness of the back air space 11; numeral 81 designates an input sound; reference character β designates an average input angle of the input sound 81; and character λ designates a wavelength of a sound wave having the highest sound pressure level among the input sounds 81. In the explanatory diagram showing a sound pressure distribution, mark + designates the operation of positive pressure on the sound absorbing plate 2; and mark − designates the operation of negative pressure on the sound absorbing plate 2. Arrows 85 and 86 designate directions of an input sound wave operating on the back air space 11 through the sound absorbing plate 2.

Next, the operation thereof will be described. The input sound 81 passes through the sound absorbing plate 2 to be input into the back air space 11. The sound absorbing plate 2 has acoustic mass m and acoustic resistance r as the acoustic characteristics thereof, and the back air space 11 has acoustic capacity c as the acoustic characteristic thereof. The acoustic equivalent circuit according to the acoustic characteristics of the sound absorbing plate 2 and the back air space 11 can be expressed as a series resonance circuit of r-m-c. According to this series resonance circuit, the resonance frequency thereof $f_0$ is expressed as the following formula.

$$f_0=(1/2\pi)\times\sqrt{(1/mc)} \quad (1)$$

When a sound wave having a frequency close to this resonance frequency $f_0$ is input into the sound absorbing plate 2, the input impedance observed from the sound source side becomes minimum. Accordingly, only the acoustic resistance r of the sound absorbing plate 2 should be considered. If the acoustic resistance r of the sound absorbing plate 2 is tuned to be a value close to the characteristic impedance ρ×a (ρ: density of air; a: sound velocity) of air, the sound absorption coefficient becomes 1.0 at the resonance frequency $f_0$. Consequently, the sound wave having the frequency close to the resonance frequency $f_0$ penetrates into the sound absorbing mechanism most efficiently. The penetrated sound wave forces the air existing in the back air space 11 and having an acoustic characteristic of acoustic capacity c to vibrate. The vibrated air goes in and out through gaps in the sound absorbing plate 2, and the sound wave is transformed into thermal energy by the acoustic resistance r of the gaps. That makes it possible to radiate energy. This means that the energy of the input sound wave was absorbed in the sound absorbing mechanism, namely sound absorption has been performed.

In the aforementioned sound absorption mechanism, it is known that the efficiency of sound absorption is highest in the case where the input sound 81 is input into the sound absorption plate 2 perpendicularly. That is to say, in the case where a sound wave is input perpendicularly, the phase relation of the sound wave on the top surface of the sound absorbing plate 2 is equal at any place on the top surface, and the whole of the sound absorbing plate 2 and the whole of the back air space 11 are unified consequently, so that the effective operation of resonance and sound absorption is performed. On the other hand, the case where the input sound 81 is input into the sound absorbing plate 2 not perpendicularly but at a certain input angle β ill be considered as an ordinary case. As shown in FIG. 44, when a sound wave having a wavelength λ is input into the sound absorbing plate 2 at an input angle B, a phase difference having a period of λ/cos (β) of sound pressure distribution is generated on the sound absorbing plate 2. A sound wave is basically absorbed by utilizing a resonance phenomenon. But, if a distribution of the strength of sound pressure is generated along a direction on a surface of the sound absorbing plate 2, pressures 85 and 86 having reverse directions to each other operate on the back air space 11, so that adjoining parts of the back air space 11 is acoustically oscillated reversely. Then, pressures are balanced in the back air space 11, and consequently it becomes difficult that air vibrations synchronized with input sound waves are generated. That is to say, it becomes difficult that resonance phenomena are generated between the sound absorbing plate 2 and the back air space 11, so that sound absorption effect is extremely checked.

Prior Art 2

FIG. 45 is a longitudinal sectional view showing a sound absorbing mechanism utilizing a sound absorbing material and a resonance phenomenon by combining them as a second prior art (prior art 2), which is shown, for example, in Japanese Patent Gazette No. 76116/1992 (Tokko-Hei 4-76117). FIG. 46 is a sound absorption characteristic diagram of the sound absorbing mechanism shown in FIG. 45. In FIG. 45, reference numeral 91 designates a wall; numerals 92 and 93 designate air spaces; numeral 94 designates a small opening or a slit; numeral 95 designates a nozzle; numeral 96 designates a porous plate; and numeral 97 designates a sound absorbing material.

Next, the operation thereof will be described. The aforementioned sound absorbing mechanism of the prior art 2 is provided with a porous plate 96 apart from the wall 91 with the air space 92 between. The porous plate 96 has a large number of small openings or slits 94, which are provided with nozzles 95 connected to them. Across the porous plate 96, the sound absorbing material 97 which is made of a fibrous material or a material made of a large number of particles is set over the whole plane at the tips of the nozzles 95 with the air space 93 between. In this connection, the air space 92, the small openings or slits 94 and the nozzles 95 comprise sound absorbing mechanisms utilizing a resonance phenomenon, and the sound absorbing material 97 and the air spaces 93 comprise sound absorbing mechanisms utilizing sound absorbing materials. The aforementioned elements of the sound absorbing mechanisms utilizing a resonance phenomenon are connected to each other through the air space 92, and the elements of the sound absorbing mechanisms utilizing sound absorbing materials are connected to each other through the air space 93.

The sound absorbing mechanism of the prior art 2 has a sound absorption characteristic of the curved line 3 shown with a solid line in FIG. 46. A sound absorption characteristic of a sound absorbing mechanism utilizing only a resonance phenomenon is shown with a dotted line (curved line 2) in FIG. 46, which sound absorbing mechanism has large sound reduction effects at lower frequencies. A sound absorption characteristic of a sound absorbing mechanism utilizing only sound absorbing materials is shown with a dashed line (curved line 1) in FIG. 46, which sound absorbing mechanism has large sound reduction effects at higher frequencies.

Prior Art 3

FIG. 47 is a partially cutaway perspective view showing the construction of a conventional sound absorbing mechanism as a third prior art (prior art 3), which utilizes both the slits and a porous material and is shown, for example, at pp. 245–250 and pp. 351–356 of *Kenchiku Onkyo Kogaku Hando Bukku* (*Architectural Acoustics Handbook*) ed. by Nippon Onkyo Zairyo Kyokai (Japan Acoustical Materials Association) (Gihodo, Tokyo, 1963). FIG. 48 is a sound absorption characteristic diagram of the sound absorbing mechanism shown in FIG. 47. In FIG. 47, reference numeral 91 designates a wall; numerals 92 and 93 designate air spaces; numeral 98 designates a porous material; and numeral 99 designates a slit plate.

Next, the operation thereof will be described. The aforementioned sound absorbing mechanism of the prior art 3, which uses a structure utilizing slits and a porous material, raises the sound absorption characteristics of the porous material 98 and the air space 92 by means of the resonance phenomena of the slit plates 99 and the air spaces 93. As shown in FIG. 48, the raised sound absorption characteristics are particularly effective at lower frequencies around 200 to 500 Hz due to the resonance phenomena at the slit parts.

Since the sound absorbing mechanism of the prior art 1 is constructed as mentioned above, the resonance frequency $f_0$ is determined in accordance with the thickness 11*a* of the back air space 11 if the sound absorbing plate 2 is specified. The sound absorption coefficient becomes maximum at the resonance frequency $f_0$, and the sound absorption characteristic has large values in a narrow frequency band with the resonance frequency $f_0$ as a ⅓ octave band center frequency. Since some sound pressure distributions are generated in some directions on the sound absorbing plate 2 when sound waves are input into the sound absorbing plate 2 at angles other than a right angle, the prior art 2 has a problem that the interference of input sound waves is generated at some frequencies according to phase differences to bring about the reduction of the sound absorption coefficient.

Since the sound absorbing mechanism of the prior art 2 is constructed as mentioned above so that a sound absorbing mechanism utilizing a resonance phenomenon to be generated by elements connected to each other and a sound absorbing mechanism utilizing sound absorbing materials connected to each other are combined to absorb sound waves, the prior art 2 has problems that some sound pressure distributions are generated in some directions on the sound absorbing material 97 when sound waves are input into the sound absorbing material 97 at angles other than a right angle similarly in the prior art 1, so that the interference of input sound waves is generated at some frequencies according to phase differences to bring about the reduction of the sound absorption coefficients at lower frequencies as shown in, for example, FIG. 46.

The sound absorbing mechanism of the prior art 3, which utilizes slits and a porous material, has a problem that the sound absorption coefficients at lower frequencies around 200 Hz to 500 Hz are large due to sound resonance phenomena at the slits but the sound absorption coefficients at higher frequencies more than 500 Hz are small.

SUMMARY OF THE INVENTION

In view of the foregoing, it is an object of the present invention to provide a sound absorbing mechanism using a porous material which has a superior sound absorption characteristic from lower frequencies to higher frequencies by forming back air spaces in supporting members and forming resonators with hollow members.

It is another object of the present invention to provide a sound absorbing mechanism using a porous material which has a superior sound absorption characteristic from lower frequencies to higher frequencies by disposing plural reflecting members in front of a sound absorbing plate.

It is a further object of the present invention to provide a sound absorbing mechanism using a porous material which has a superior sound absorption characteristic from lower frequencies to higher frequencies by disposing plural reflecting members in front of a sound absorbing plate and equipping a protecting plate having an opening.

It is a further object of the present invention to provide a sound absorbing mechanism using a porous material which has a superior sound absorption characteristic from lower frequencies to higher frequencies by disposing plural sound absorbers composed of a thin plate of a porous material and a hollow member in front of a sound absorbing plate.

It is a further object of the present invention to provide a sound absorbing mechanism using a porous material which has a superior sound absorption characteristic from lower frequencies to higher frequencies by disposing plural sound absorbers, which are composed of a thin plate of a porous material and a hollow member, and a protecting plate having an opening in front of a sound absorbing plate.

It is a further object of the present invention to provide a sound absorbing mechanism using a porous material which has a superior sound absorption characteristic from lower frequencies to higher frequencies by forming a sound absorbing plate of a porous material and equipping plural reflecting members.

It is a further object of the present invention to provide a sound absorbing mechanism using a porous material which has a superior sound absorption characteristic from lower frequencies to higher frequencies by disposing a protecting plate having an opening in front of reflecting members.

It is a further object of the present invention to provide a sound absorbing mechanism using a porous material which has a superior sound absorption characteristics from lower frequencies to higher frequencies by forming a sound absorbing plate of a porous material and equipping plural sound absorbers made of a thin plate of a porous material and a hollow member.

It is a further object of the present invention to provide a sound absorbing mechanism using a porous material which has a superior sound absorption characteristic from lower frequencies to higher frequencies by disposing a protecting plate having an opening in front of plural sound absorbers.

It is a further object of the present invention to provide a sound absorbing mechanism using a porous material which has a superior sound absorption characteristic from lower frequencies to higher frequencies by forming a sound absorbing plate made by welding plastic particles partially.

It is a further object of the present invention to provide a sound absorbing mechanism using a porous material which has a superior sound absorption characteristic from lower frequencies to higher frequencies by forming a sound absorbing panel by equipping a sound insulating plate at the back of a sound absorbing mechanism.

It is a further object of the present invention to provide a sound absorbing mechanism using a porous material which has a superior sound absorption characteristic from lower frequencies to higher frequencies by equipping a third hollow member for forming a second resonator having a third back air space in each inside of first hollow members.

According to the first aspect of the present invention, for achieving the above-mentioned objects, there is provided a sound absorbing mechanism using a porous material which sound absorbing mechanism supports a sound absorbing plate made of a thin plate of a porous material above a sound insulator, forms separated plural first back air spaces by separating a space between the sound absorbing plate and the sound insulator, and forms a first resonator having a second back air space in each first back air space.

As stated above, the sound absorbing mechanism using a porous material according to the first aspect of the present invention improves the sound absorption characteristic thereof by separating the sound absorbing function thereof by means of the first resonators having a second back air space which resonators are formed in each separated plural first back air space formed by separating the space between the sound absorbing plate and the sound insulator, and consequently, a sound absorbing mechanism having a superior sound absorption characteristic from lower frequencies to higher frequencies can be obtained.

According to the second aspect of the present invention, there is provided a sound absorbing mechanism using a porous material which sound absorbing mechanism comprises plural reflecting members disposed in front of a sound absorbing plate with a space from the sound absorbing plate.

As stated above, the sound absorbing mechanism using a porous material according to the second aspect of the present invention makes it easy to bring about a resonance phenomenon and improves the sound absorbing performance thereof by comprising plural reflecting members disposed in front of a sound absorbing plate with a space from the sound absorbing plate, and consequently, a sound absorbing mechanism having a superior sound absorption characteristic from lower frequencies to higher frequencies can be obtained.

According to the third aspect of the present invention, there is provided a sound absorbing mechanism using a porous material which sound absorbing mechanism comprises plural reflecting members disposed in front of a sound absorbing plate with a space from the sound absorbing plate, and a protecting plate disposed in front of the reflecting members for fixing the reflecting members which protecting plate has an opening.

As stated above, the sound absorbing mechanism using a porous material according to the third aspect of the present invention improves the sound absorbing performance thereof by comprising plural reflecting members disposed in front of a sound absorbing plate with a space from the sound absorbing plate and a protecting plate disposed in front of the reflecting members which protecting plate has an opening, and consequently, a sound absorbing mechanism having a superior sound absorption characteristic from lower frequencies to higher frequencies can be obtained.

According to the fourth aspect of the present invention, there is provided a sound absorbing mechanism using a porous material which sound absorbing mechanism comprises plural sound absorbers composed of a thin plate of a porous material and a second hollow member, which sound absorbers are disposed in front of a sound absorbing plate with a space from the sound absorbing plate.

As stated above, the sound absorbing mechanism using a porous material according to the fourth aspect of the present invention improves the sound absorbing performance thereof by comprising plural sound absorbers composed of a thin plate of a porous material and a second hollow member, which sound absorbers are disposed in front of a sound absorbing plate with a space from the sound absorbing plate, and consequently, a sound absorbing mechanism having a superior sound absorption characteristic lower frequencies to higher frequencies can be obtained.

According to the fifth aspect of the present invention, there is provided a sound absorbing mechanism using a porous material which sound absorbing mechanism comprises plural sound absorbers composed of a thin plate of a porous material and a second hollow member, which sound absorbers are disposed in front of a sound absorbing plate with a space from the sound absorbing plate, and a protecting plate disposed in front of the sound absorbers for fixing the sound absorbers, which protecting plate has an opening.

As stated above, the sound absorbing mechanism using a porous material according to the fifth aspect of the present invention improves the sound absorbing performance thereof by comprising plural sound absorbers composed of a thin plate of a porous material and the second hollow member, which sound absorbers are disposed in front of a sound absorbing plate with a space from the sound absorbing plate, and a protecting plate disposed in front of the sound absorbers, which protecting plate has an opening, and consequently, a sound absorbing mechanism having a superior sound absorption characteristic from lower frequencies to higher frequencies can be obtained.

According to the sixth aspect of the present invention, there is provided a sound absorbing mechanism using a porous material which sound absorbing mechanism comprises a sound absorbing plate made of a thin plate of a porous material and disposed above a sound insulator with a back air space between, and plural reflecting members disposed in front of the sound absorbing plate with a space from the sound absorbing plate.

As stated above, the sound absorbing mechanism using a porous material according to the sixth aspect of the present invention improves the sound absorbing coefficients thereof at higher frequencies by comprising a sound absorbing plate made of a thin plate of a porous material and disposed above a sound insulator with a back air space between, and plural reflecting members disposed in front of the sound absorbing plate with a space from the sound absorbing plate, and consequently, a sound absorbing mechanism having a superior sound absorption characteristic from lower frequencies to higher frequencies can be obtained.

According to the seventh aspect of the present invention, there is provided a sound absorbing mechanism using a porous material which sound absorbing mechanism comprises a protecting plate disposed in front of reflecting members for fixing the reflecting members, which protecting plate has an opening.

As stated above, the sound absorbing mechanism using a porous material according to the seventh aspect of the present invention improves the sound absorbing performance thereof by comprising a protecting plate disposed in front of reflecting members, which protecting plate has an opening, and consequently, a sound absorbing mechanism having a superior sound absorption characteristic from lower frequencies to higher frequencies can be obtained.

According to the eighth aspect of the present invention, there is provided a sound absorbing mechanism using a porous material which sound absorbing mechanism comprises a sound absorbing plate made of a thin plate of a porous material and disposed above a sound insulator such as a wall with a back air space between and plural sound absorbers composed of a thin plate of a porous material and a hollow member, which sound absorbers are disposed in front of the sound absorbing plate with a space from the sound absorbing plate.

As stated above, the sound absorbing mechanism using a porous material according to the eighth aspect of the present invention improves the sound absorbing performance thereof by disposing plural sound absorbers composed of a thin plate of a porous material and a hollow member in front of a sound absorbing plate with a space from the sound absorbing plate, and consequently, a sound absorbing mechanism having a superior sound absorption characteristic from lower frequencies to higher frequencies can be obtained.

According to the ninth aspect of the present invention, there is provided a sound absorbing mechanism using a porous material which sound absorbing mechanism comprises a protecting plate disposed in front of plural sound absorbers for fixing the sound absorbers, which protecting plate has an opening.

As stated above, the sound absorbing mechanism using a porous material according to the ninth aspect of the present invention improves the sound absorbing performance thereof by disposing a protecting plate having an opening in front of a plural sound absorbers, and consequently, a sound absorbing mechanism having a superior sound absorption characteristic from lower frequencies to higher frequencies can be obtained.

According to the tenth aspect of the present invention, there is provided a sound absorbing mechanism using a porous material in which sound absorbing mechanism a sound absorbing plate is made by welding plastic particles partially.

As stated above, the sound absorbing mechanism using a porous material according to the tenth aspect of the present invention uses a sound absorbing plate made by welding plastic particles partially, and consequently, a sound absorbing mechanism having a superior sound absorption characteristic from lower frequencies to higher frequencies can be obtained.

According to the eleventh aspect of the present invention, there is provided a sound absorbing mechanism using a porous material which sound absorbing mechanism is formed as a sound absorbing panel by equipping a sound insulating plate corresponding to a sound insulator at a back of a sound absorbing mechanism.

As stated above, the sound absorbing mechanism using a porous material according to the eleventh aspect of the present invention is formed as a sound absorbing panel by equipping a sound insulating plate corresponding to a sound insulator at the back of a sound absorbing mechanism, and consequently, a sound absorbing mechanism having a superior sound absorption characteristic from lower frequencies to higher frequencies can be obtained.

According to the twelfth aspect of the present invention, there is provided a sound absorbing mechanism using a porous material which sound absorbing mechanism comprises a third hollow member fixed to a back of a sound absorbing plate for forming a second resonator having a third back air space separated from a second back air space in each inside of first hollow members.

As stated above, the sound absorbing mechanism using a porous material according to the twelfth aspect of the present invention comprises a third hollow member for forming a second resonator having a third back air space, and consequently, a sound absorbing mechanism having a superior sound absorption characteristic from lower frequencies to higher frequencies can be obtained.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Preferred embodiments of the present invention will now be described in detail with reference to the accompanying drawings.

Embodiment 1

Figure 1:
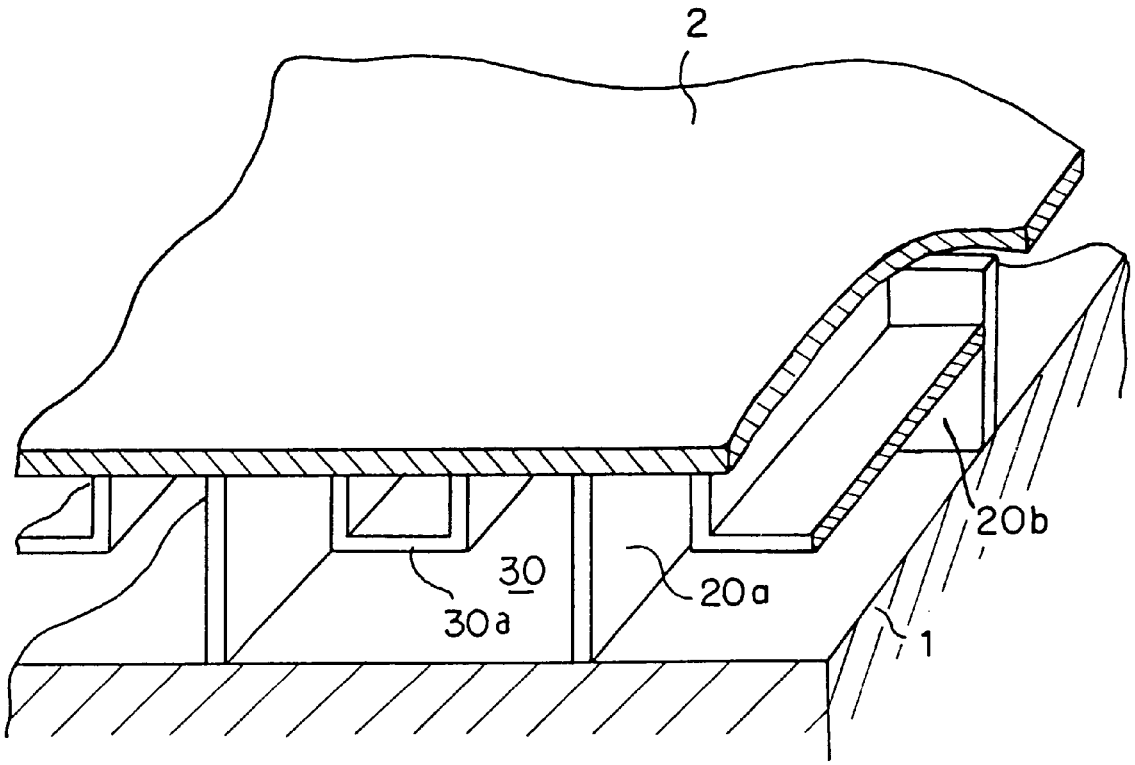
FIG. 1 is a perspective view showing the construction of a sound absorbing mechanism using a porous material according to the embodiment 1 of the present invention.
Figure 2:
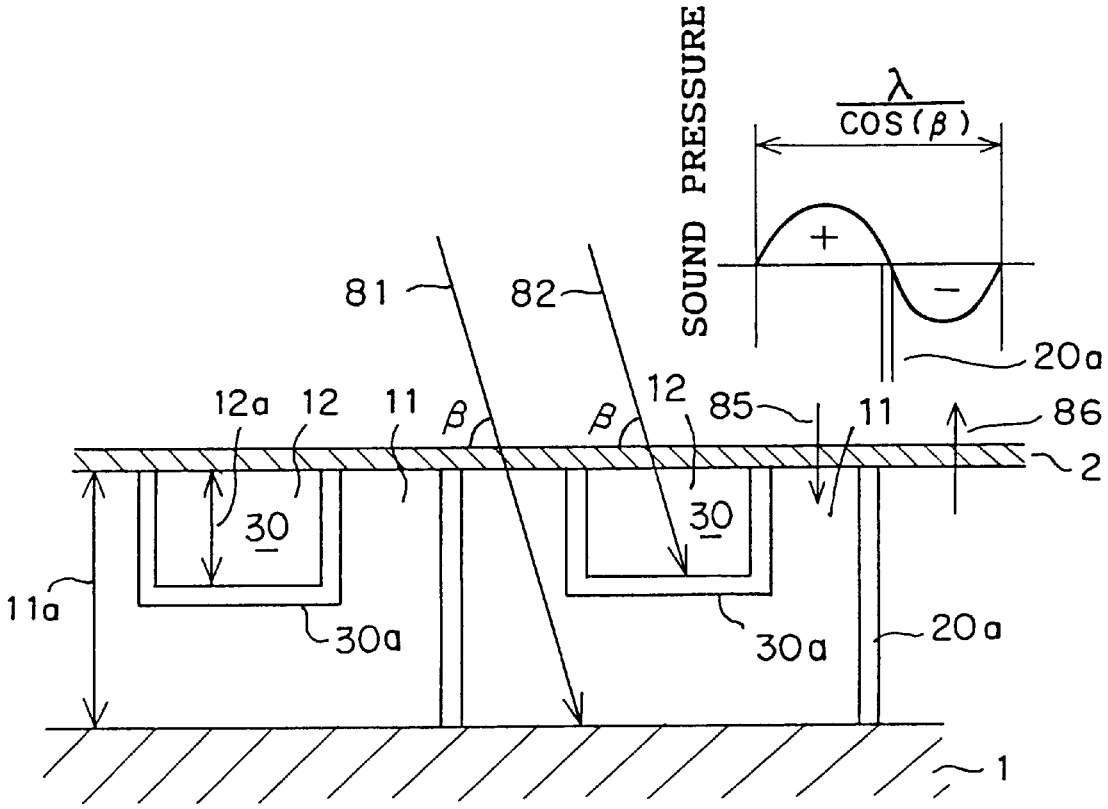
FIG. 2 is a longitudinal sectional view showing the construction of a sound absorbing mechanism using a porous material according to the embodiment 1 of the present invention, including an explanatory diagram showing a sound pressure distribution of a sound wave to be input into the sound absorbing plate thereof.

FIG. 1 is a perspective view showing the construction of a sound absorbing mechanism using a porous material according to a first embodiment (embodiment 1) of the present invention; and FIG. 2 is a longitudinal sectional view showing the construction of a sound absorbing mechanism using a porous material shown in FIG. 1, including an explanatory diagram showing a sound pressure distribution of a sound wave to be input into the sound absorbing plate thereof. In FIGS. 1 and 2, reference numeral 1 designates a sound insulator such as a wall. Reference numeral 2 designates a sound absorbing plate made of a thin plate of a porous material, which is made of plastic particles, a ceramic, foam metal or the like. A porous material made by heating and welding plastic particles partially, which porous material has a high sound absorption effect exceptionally, is disclosed in Japanese Published Unexamined Patent Application of No. 289333/1990 (Tokkai-Hei 2-289333) having been filed by the same assignee as that of the present invention. The porous material disclosed in the publication is hereby incorporated in the present invention by reference. The porous material which has a density gradient in the thickness direction thereof has furthermore superior sound absorption effect. It is desirable that porous materials to be used in the present invention should have mechanical strength for forming the sound absorbing mechanism. Reference numerals 11 and 12 designate back air spaces of the sound absorbing plate 2; and numerals 11*a* and 12*a* designate respective thicknesses of the back air spaces 11 and 12. Reference numerals 20*a* and 20*b* designate latticed supporting members for supporting the sound absorbing plate 2 above the sound insulator 1 with the space of the thickness 11*a* of the back air space 11. The supporting members 20*a* and 20*b* separates the space between the sound insulator 1 and the sound absorbing plate 2 into a lattice to form plural separated back air spaces 11. Reference numeral 30*a* designates hollow members fixed to the back of the sound absorbing plate 2 for forming separated back air spaces 12 thinner than the back air spaces 11 in each of the plural back air spaces 11. The hollow members 30*a* and the sound absorbing plate 2 constitute plural separated resonators 30. Reference numeral 81 designates an input sound into a back air space 11; and numeral 82 designates an input sound into a back air space 12. Reference character β designates an average input angle of the input sounds 81 and 82; and character λ designates a wavelength of the input sound 81 or 82. In the explanatory diagram of FIG. 2, which shows the sound pressure distribution, mark + designates the operation of positive pressure on the sound absorbing plate 2; and mark − designates the operation of negative pressure on the sound absorbing plate 2. Arrow 85 of FIG. 2 designates a positive pressure of an input sound wave operating on the back air space 11 or 12 through the sound absorbing plate 2; and arrow 86 designates a negative pressure of an input sound wave operating on the back air space 11 or 12 through the sound absorbing plate 2.

Such materials as polypropylene resin, polyvinyl chloride resin, ABS resin and polycarbonate resin can be used as the material of the sound absorbing plate 2. Since the sound absorbing plate 2 is supported by the supporting members 20*a* and 20*b*, the strength of the sound absorbing plate 2 is increased.

Next, the operation thereof will be described. The principle of sound absorption of the sound absorbing mechanism is expressed by means of the acoustic equivalent circuit of the sound absorbing plate 2 and the back air spaces 11 similarly in the prior art 1. The sound absorbing plate 2 corresponds to acoustic mass m and acoustic resistance r, and the back air spaces 11 corresponds to acoustic capacity c. They form a series resonance circuit of r-m-c. The resonance frequency $f_0$ thereof is determined in conformity with the aforementioned formula (1) in the prior art 1.

The resonance frequency $f_0$ of the input sound 81 is determined mainly in accordance with the thickness 11*a* of the back air spaces 11 if the sound absorbing plate 2 is specified. The resonance frequency $f_0$ of the input sound 82 is also determined mainly in accordance with the thickness 12*a* of the back air space 12. The sound absorption coefficients respectively become maximum at the resonance frequencies $f_0$ of them. Since each sound absorbing mechanism is independent of the other, the total sound absorption characteristic is the sum of respective sound absorption characteristics, and the sound absorption coefficients thereof are consequently improved from lower frequencies to higher frequencies as compared with those of the prior arts.

In the aforementioned sound absorption mechanism, it is known that the efficiency of sound absorption is highest in the case where the input sound 81 is input into the sound absorption plate 2 perpendicularly. That is to say, in the case where a sound wave is input perpendicularly, the phase relations of the sound wave on the top surface of the sound absorbing plate 2 are equal at any place on the top surface, and the whole of the sound absorbing plate 2 and the whole of the back air spaces 11 or 12 are consequently unified, so that the effective operation of resonance and sound absorption is performed. On the other hand, the case where the input sound 81 is input into the sound absorbing plate 2 not perpendicularly but at a certain input angle β will be considered as an ordinary case. As shown in FIG. 2, when a sound wave having a wavelength λ is input into the sound absorbing plate 2 at an input angle β, a phase difference having a period of λ/cos (β) of sound pressure distribution is generated on the sound absorbing plate 2. In the sound absorption mechanism to be described here, a sound wave is basically absorbed by utilizing a resonance phenomenon. If a phase difference of sound pressure is generated along a direction on a surface of the sound absorbing plate 2, the efficiency of sound absorption is reduced due to the phase difference in the case where back air spaces are connected at the backside of the sound absorbing plate 2 as in the prior arts 1 and 2. But, the back air spaces 11 are separated from each other by the supporting members 20*a*, 20*b*, and the back air spaces 12 are separated from the back air spaces 11, and then from each other, by the resonators 30 and the supporting members 20*b*, respectively, in the present embodiment. Consequently, each back air space 11 and each back air space 12 respectively operates independently, and thereby it becomes easy to generate resonance phenomena, which brings about the improvement of the sound absorption performance thereof. Since the interference of sound waves due to phase differences is thus little, the present sound absorbing mechanism has larger sound absorption coefficients as compared with those of the prior arts.

In FIGS. 1 and 2, the embodiment 1 has latticed supporting members 20*a* and 20*b*, but the present invention comprises the use of the supporting members 20*a* alone or the supporting members 20*b* alone. By such usage, a part of the effects of the present embodiment can be obtained.

Embodiment 2

Figure 3:
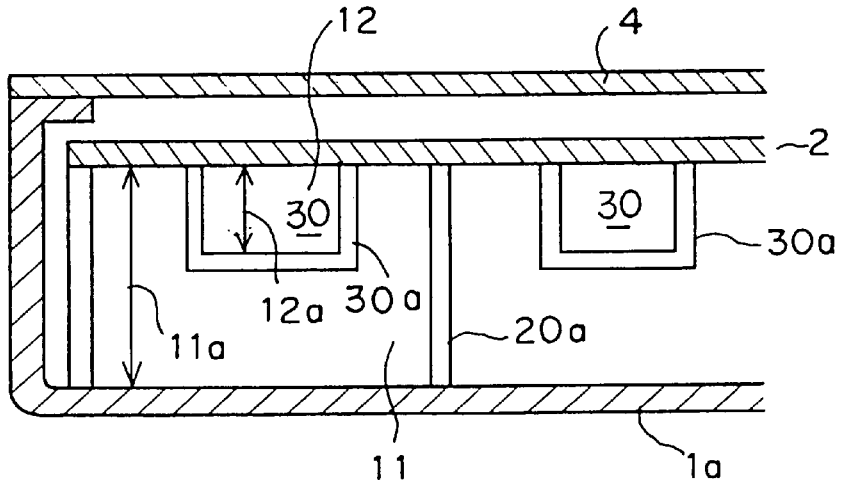
FIG. 3 is a longitudinal sectional view showing the construction of a sound absorbing panel using a porous material according to the embodiment 2 of the present invention.
Figure 4:
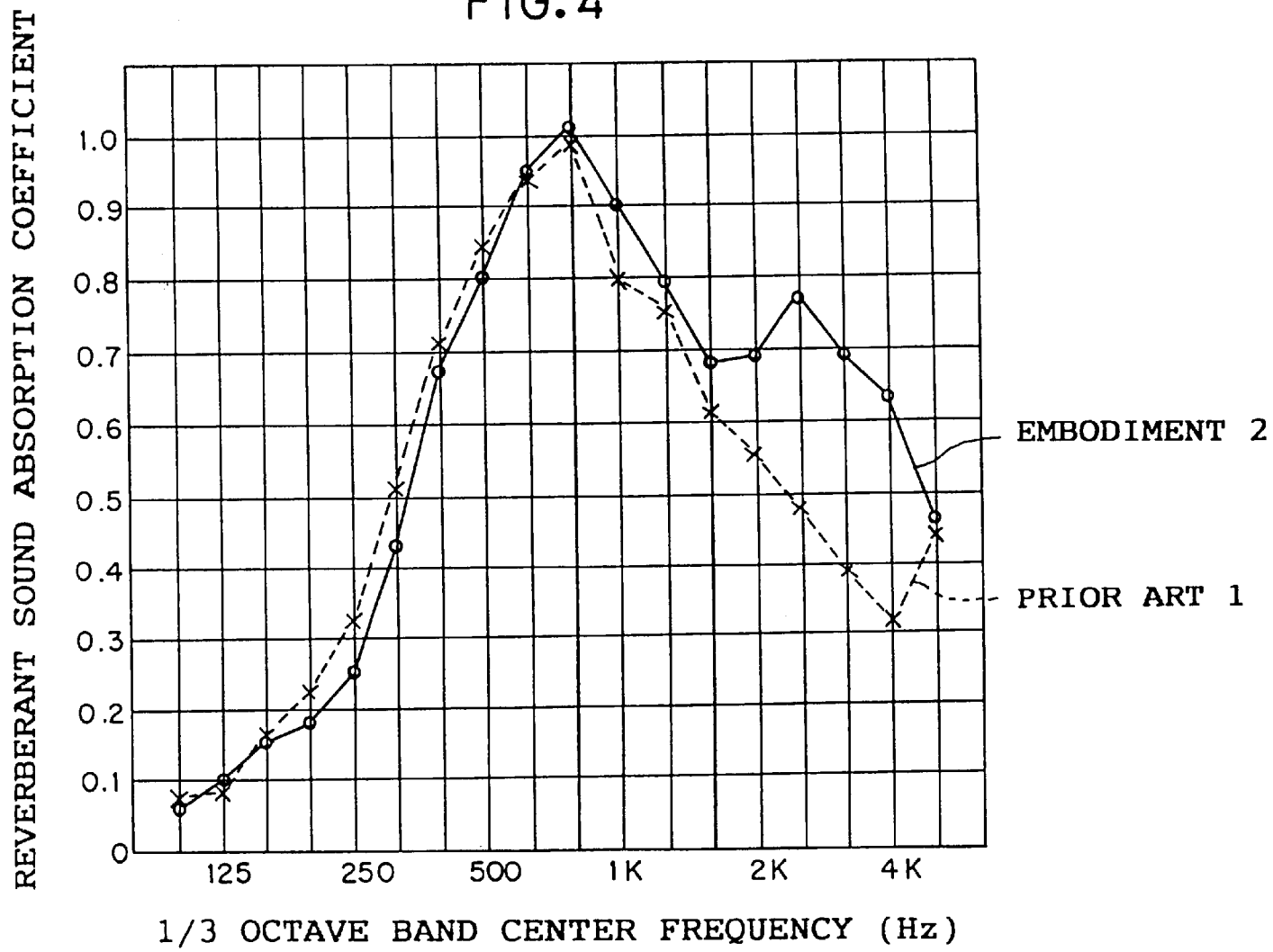
FIG. 4 is a sound absorption characteristic diagram of a sound absorbing panel using a porous material according to the embodiment 2 of the present invention in conformity with the method for measurement of sound absorption coefficients in a reverberation room.

FIG. 3 is a longitudinal sectional view showing the construction of a sound absorbing panel using a hard porous material according to a second embodiment (embodiment 2) of the present invention; and FIG. 4 is a sound absorption characteristic diagram in conformity with the method for measurement of sound absorption coefficients in a reverberation room. In FIG. 3, reference numeral 1*a* designates a sound insulating plate also serving as a housing of the sound absorbing panel, which sound absorbing plate 1*a* corresponds to an insulator such as a wall. Reference numeral 4 designates a protecting plate made of a punching metal or the like, which protecting plate 4 has at least one opening and is fixed to the insulating plate 1*a* so as to cover the opened part of the sound insulating plate 1*a*.

Next, the operation thereof will be described. The sound absorbing panel is constructed by forming, for example, a galvanized steel plate having the thickness of 1.6 mm into a box sized to be about 500 mm×1960 mm×50 mm as the sound insulating plate 1*a*, and by placing the sound absorbing plate 2 having the thickness of about 3.5 mm in the box so that the thickness 11*a* of the back air spaces 11 becomes about 35 mm, to which sound absorbing plate 2 resonators 30 are fixed so that the thickness 12*a* of the back air spaces 12 becomes about 9 mm. And then, an aluminum plate having the thickness of 0.8 mm and the rate of opened area of 55% is fixed to the sound insulating plate 1*a* as the protecting plate 4. The sound absorption characteristic of the sound absorbing panel thus constructed has larger sound absorption coefficients at higher frequencies as compared to those of the prior art 1, and is totally improved at a wider frequency band, as shown in FIG. 4. According to the results of some experiments, the sound absorption coefficients thereof are furthermore improved at the thickness 12*a* of the back air space 12 being about 15 mm.

Embodiment 3

Figure 5:
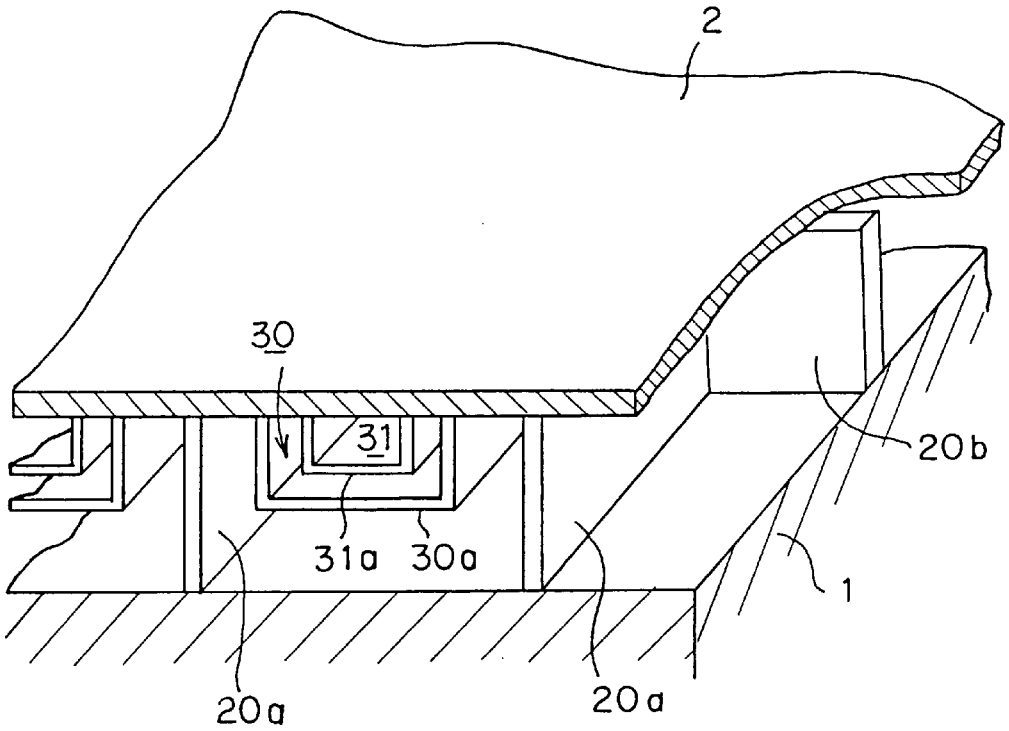
FIG. 5 is a perspective view showing the construction of a sound absorbing mechanism using a porous material according to the embodiment 3 of the present invention.
Figure 6:
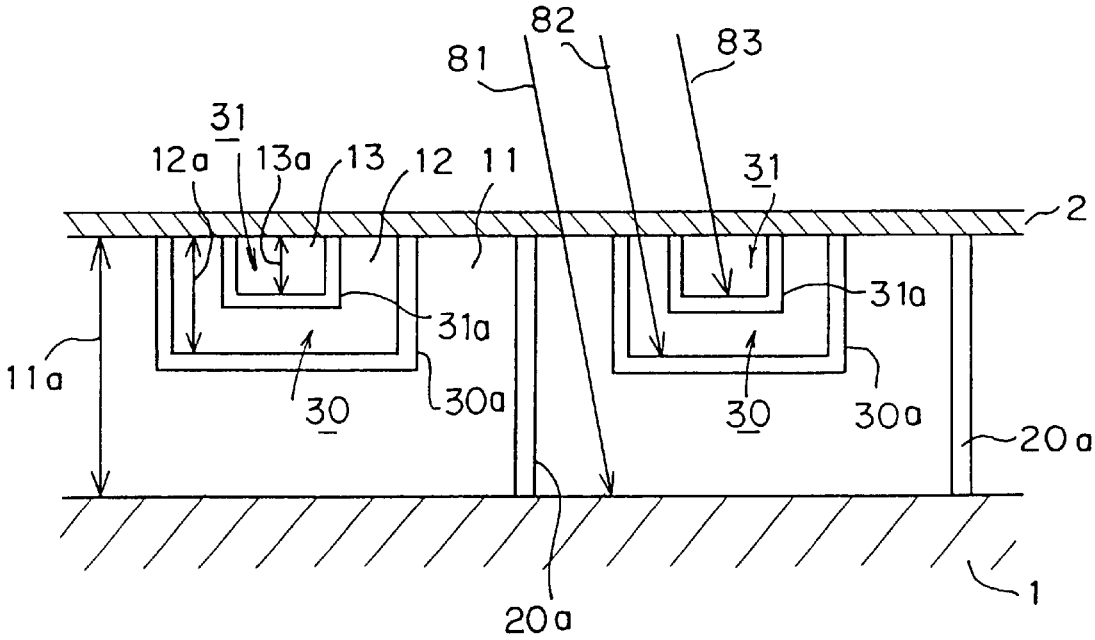
FIG. 6 is a longitudinal sectional view showing the construction of a sound absorbing mechanism using a porous material according to the embodiment 3 of the present invention.

FIG. 5 is a perspective view showing the construction of a sound absorbing mechanism using a porous material according to a third embodiment (embodiment 3) of the present invention; and FIG. 6 is a longitudinal sectional view showing the sound absorbing mechanism using a porous material of FIG. 5. In FIGS. 5 and 6, reference numeral 13 designates back air spaces of the sound absorbing plate 2; and numeral 13*a* designates the thickness of the back air spaces 13. Reference numeral 31 designates resonators fixed to the back of the sound absorbing plate 2 in the resonators 30 with the space of the thickness 13*a* of the back air spaces 13; and numeral 31*a* designates hollow members for furthermore forming resonators 31 in the hollow members 30*a*. These resonators 30 and 31 are disposed so as to be parallel to the supporting members 20*a* and perpendicular to the supporting members 20*b*. Reference numeral 83 designates an input sound into a back air space 13.

Next, the operation thereof will be described. The resonance frequency $f_0$ of the input sound 83 is determined in accordance with the thickness 13*a* of the back air spaces 13. The sound absorption coefficients respectively become maximum when the frequencies of the input sounds 81, 82 and 83 are equal to the respective resonance frequencies $f_0$ of the back air spaces 11, 12 and 13. Since each of the three sound absorbing mechanisms are independent of each other, the total sound absorption characteristic is the sum of respective sound absorption characteristics, and the sound absorption coefficients thereof are consequently furthermore improved even if they are compared with those of the embodiment 1. Since, the back air spaces 11 are separated from each other by the supporting members 20*a*, 20*b*, and the back air spaces 12 are separated from the back air spaces 11, and then from each other, by the resonators 30 and the supporting members 20*b*, and furthermore the back air spaces 13 are separated from the back air spaces 12, and then from the back air spaces 11 and each other, by the resonators 31 and the supporting members 20*b*, respectively, each back air space 11, 12 and 13 respectively operates independently, and thereby it becomes easy to generate resonance phenomena, which brings about the improvement of the sound absorption performance thereof. Since the interference of sound waves due to phase differences is thus little, the present sound absorbing mechanism has larger sound absorption coefficients as compared with those of the prior arts 1 and 2.

In FIGS. 5 and 6, the embodiment 3 has latticed supporting members 20*a* and 20*b*, but the present invention comprises the use of the supporting members 20*a* alone or the supporting members 20*b* alone. By such usage, a part of the effects of the present embodiment can be obtained.

Embodiment 4

Figure 7:
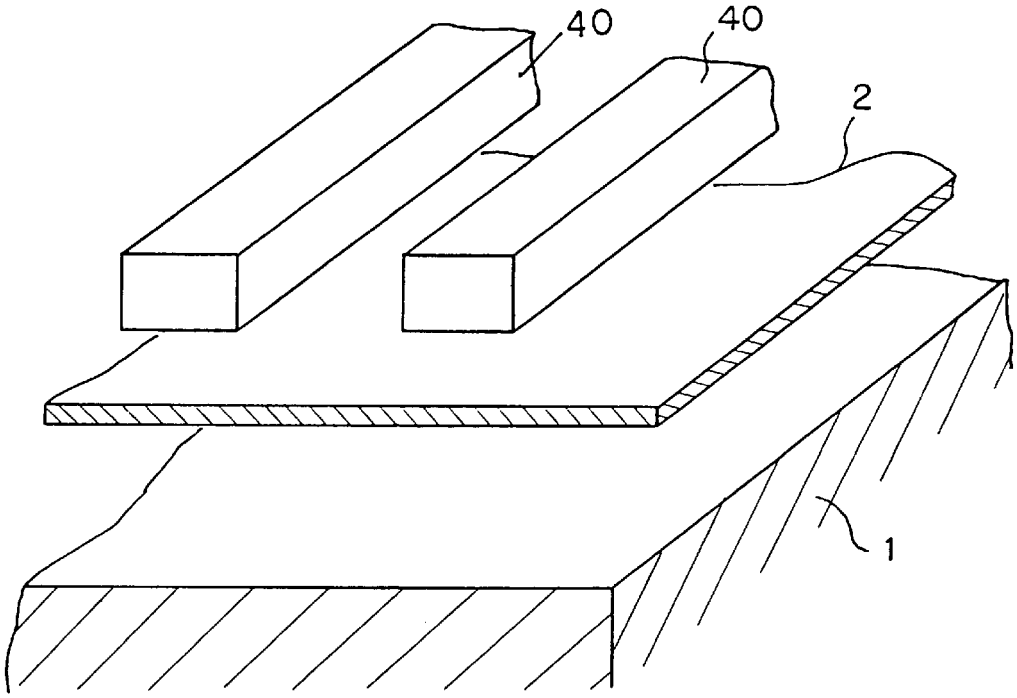
FIG. 7 is a perspective view showing the construction of a sound absorbing mechanism using a porous material according to the embodiment 4 of the present invention.
Figure 8:
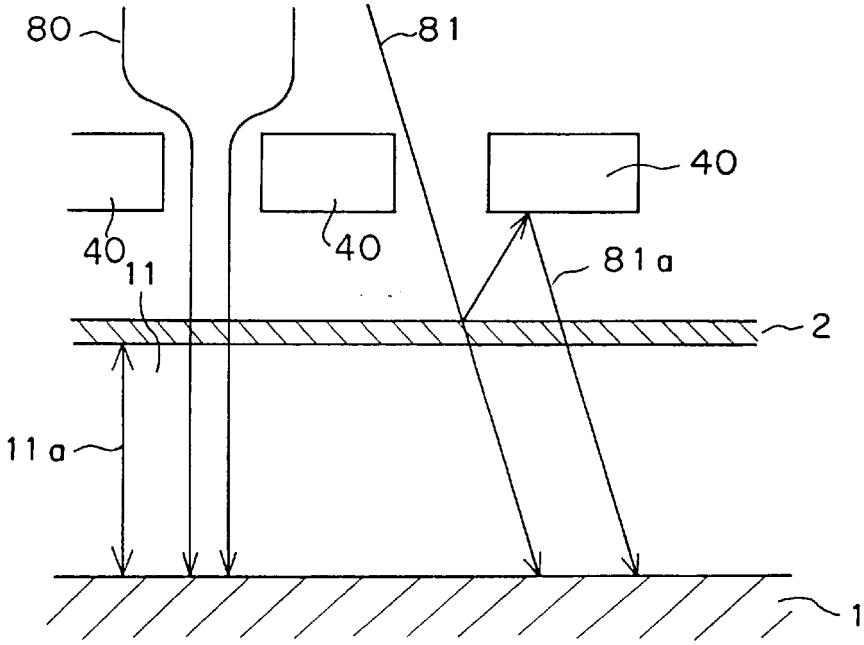
FIG. 8 is a longitudinal sectional view showing the construction of a sound absorbing mechanism using a porous material according to the embodiment 4 of the present invention.

FIG. 7 is a perspective view showing the construction of a sound absorbing mechanism using a porous material according to a fourth embodiment (embodiment 4) of the present invention; and FIG. 8 is a longitudinal sectional view showing the sound absorbing mechanism using a porous material of FIG. 7. In FIGS. 7 and 8, reference numeral 1 designates a sound insulator such as a wall. Reference numeral 2 is a sound absorbing plate similar to that of the embodiment 1. Reference numeral 11 designates a back air space of the sound absorbing plate 2; and numeral 11*a* designates the thickness of the back air space 11. Reference numeral 40 designates plural reflecting members disposed in front of the sound absorbing plate 2 so as to be opposed to the sound absorbing plate 2 with a space. Reference numeral 80 designates input sounds into the back air space 11, which input sounds 80 having evaded the reflecting members 40; numeral 81 designates an input sound into the back air space 11; and numeral 81*a* designates a re-input sound into the back air space 11 which re-input sound 81*a* is the input sound 81 having been reflected by the sound absorbing plate 2 and a reflecting member 40.

Such materials as polypropylene resin, polyvinyl chloride resin, ABS resin and polycarbonate resin can be used as the materials of the reflecting members 40. The shapes of the reflecting members 40 may be a hollowed pipe or a solid rod.

Next, the operation thereof will be described. The resonance frequency $f_0$ of the back air space 11 is determined in accordance with the thickness 11*a* thereof. Sound absorption coefficients become maximum when the frequencies of the input sounds 80 and 81 are equal to the respective resonance frequencies $f_0$. Many sounds do not pass through the sound absorbing plate 2 but are reflected on the surface thereof in the case where the sound absorbing coefficient thereof is small. Accordingly, when the reflecting members 40 are placed so as to be opposed to the sound absorbing plate 2, the reflected sounds are reflected by the reflecting members 40 again and are input into the sound absorbing plate 2 to be absorbed by it. Because sounds having a shorter wavelength become re-input sounds 81*a* more efficiently, the sound absorption coefficients at frequencies higher than the resonance frequency $f_0$ are increased, and thereby sound absorption coefficients can be improved from lower frequencies to higher frequencies as compared with those of the prior arts.

Because the re-input sounds 81*a* have propagation paths longer than those of the input sounds 81, their phases are shifted. Consequently, resonance phenomena are reinforced at some frequencies, which brings about the increase of sound absorption coefficients.

The input sounds 80 are essentially reflected on the top surfaces of the reflecting members 40, but some sound waves of them are pulled into the spaces between the reflecting members 40 owing to the phenomena such as diffraction. Because the impedance of them is matched and their input angles become close to be perpendicular, they are absorbed efficiently.

Embodiment 5

Figure 9:
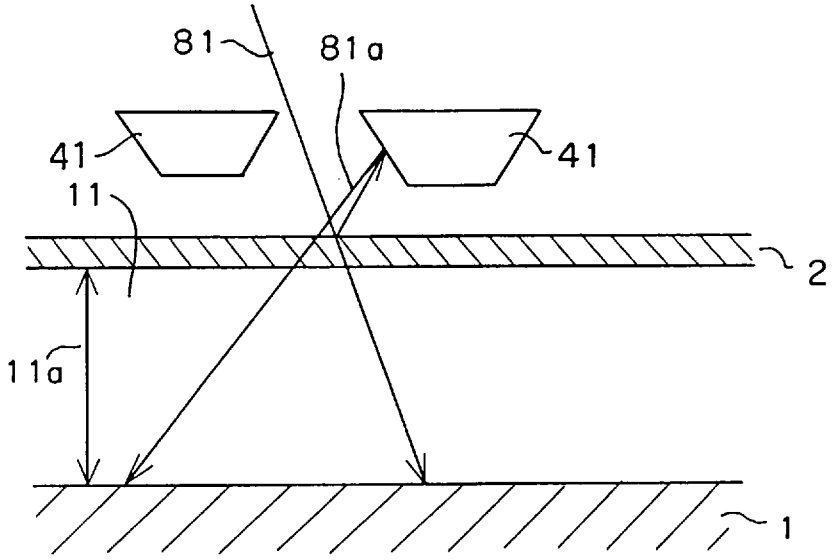
FIG. 9 is a longitudinal sectional view showing the construction of a sound absorbing mechanism using a porous material according to the embodiment 5 of the present invention.

FIG. 9 is a longitudinal sectional view showing the construction of a sound absorbing mechanism using a porous material according to a fifth embodiment (embodiment 5) of the present invention. In FIG. 5, reference numeral 41 designates plural reflecting members disposed in front of the sound absorbing plate 2 with a space from the sound absorbing plate 2 and having a sectional form of an inverted trapezoid. Because the reflecting members 41 can utilize also the side surfaces of them to reflect sound waves, re-input sounds 81*a* can be obtained more efficiently. Consequently, the sound absorption coefficients at frequencies higher than the resonance frequency $f_0$ are increased, and thereby sound absorption coefficients can be improved from lower frequencies to higher frequencies as compared with those of the prior art 1.

Embodiment 6

Figure 10:
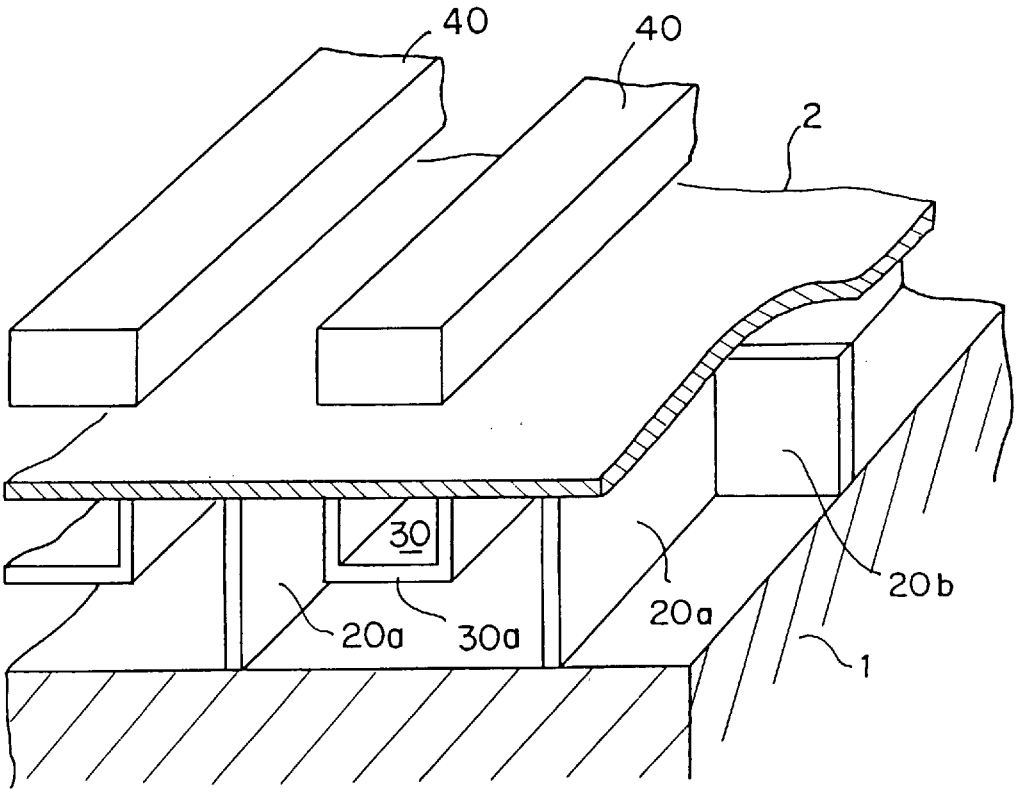
FIG. 10 is a perspective view showing the construction of a sound absorbing mechanism using a porous material according to the embodiment 6 of the present invention.
Figure 11:
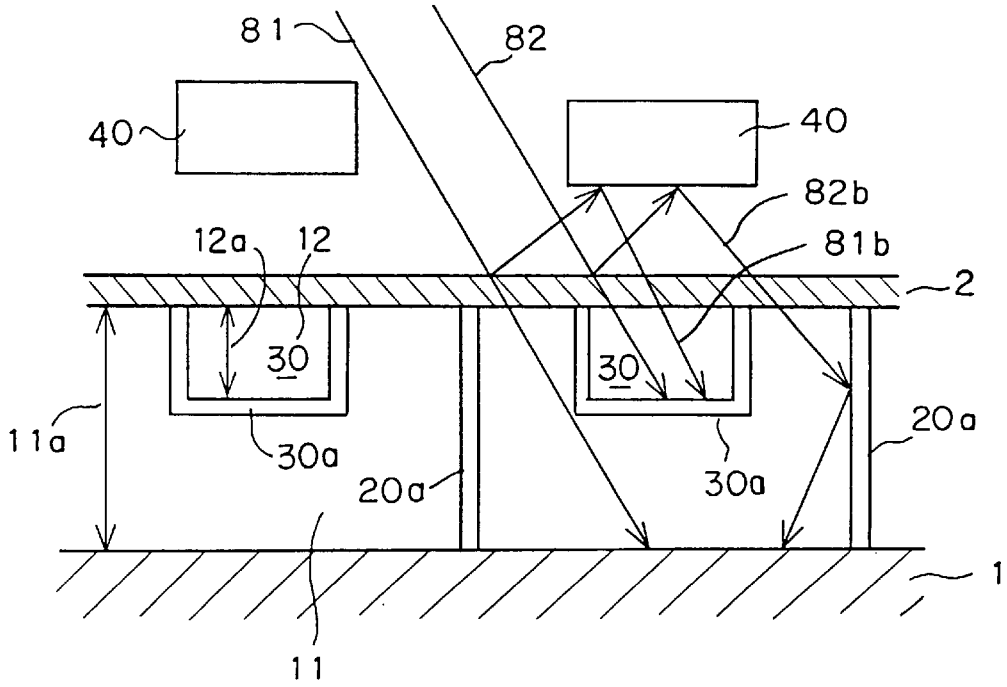
FIG. 11 is a longitudinal sectional view showing the construction of a sound absorbing mechanism using a porous material according to the embodiment 6 of the present invention.
Figure 12:
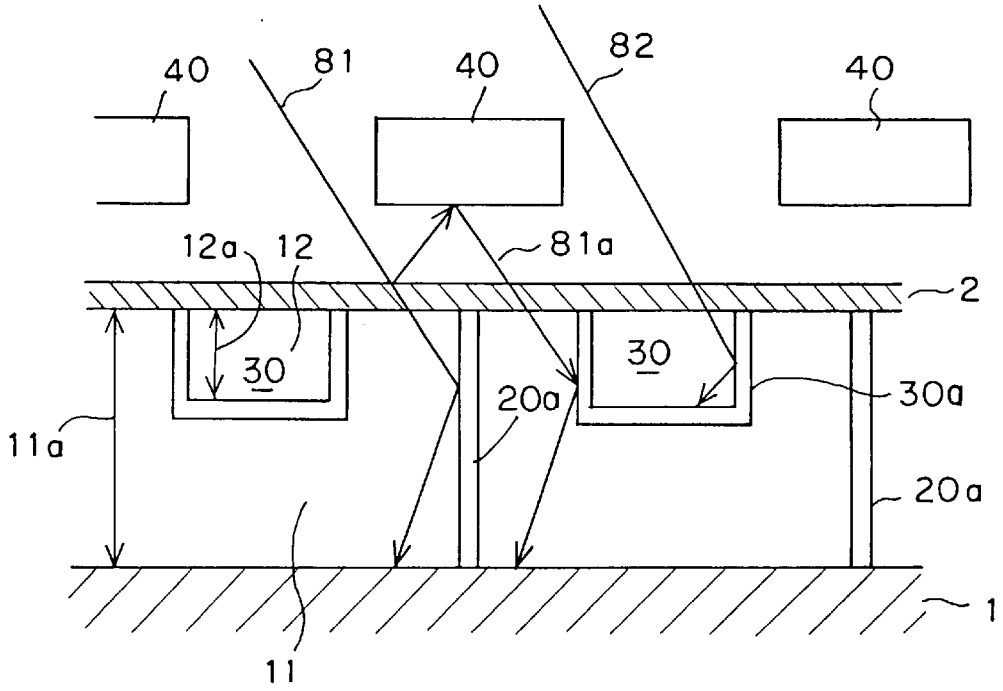
FIG. 12 is a longitudinal sectional view showing the construction of a sound absorbing mechanism using a porous material according to the embodiment 6 of the present invention.

FIG. 10 is a perspective view showing the construction of a sound absorbing mechanism using a porous material according to a sixth embodiment (embodiment 6) of the present invention; and FIGS. 11 and 12 are longitudinal sectional views showing the construction of the sound absorbing mechanism using a porous material shown in FIG. 10. In FIGS. 10, 11 and 12, reference numeral 1 designates a sound insulator such as a wall. Reference numeral 2 designates a sound absorbing plate similar to that of the embodiment 1. Reference numerals 11 and 12 designate back air spaces of the sound absorbing plate 2; and numerals 11*a* and 12*a* designate the respective thicknesses of the back air spaces 11 and 12. Reference numerals 20*a* and 20*b* designate latticed supporting members for supporting the sound absorbing plate 2 so as to be opposed to the sound insulator 1 with the space of the thickness 11*a* of the back air spaces 11. Reference numeral 30 designates resonators fixed to the insulator 1 side of the sound absorbing plate 2 with the space of the thickness 12*a* of the back air spaces 12; numeral 30*a* designates hollow members for forming the resonators 30. The resonators 30 are disposed so as to be parallel to the supporting members 20*a* and perpendicular to the supporting members 20*b*. Reference numeral 40 designates plural reflecting members disposed in front of the sound absorbing plate 2 so as to be opposed to the sound absorbing plate 2 with a space and parallel to the resonators 30. Reference numeral 81 designates an input sound into a back air space 11; numeral 81*a* designates a re-input sound into a back air space 11 which re-input sound 81*a* is the input sound 81 having been reflected by the sound absorbing plate 2 and a reflecting member 40; numeral 81*b* designates a re-input sound into a back air space 12 which re-input sound 81*b* is the input sound 81 having been reflected by the sound absorbing plate 2 and a reflecting member 40; numeral 82 designates an input sound into a back air space 12; and numeral 82*b* designates a re-input sound into a back air space 11 which re-input sound 82*b* is the input sound 82 having been reflected by the sound absorbing plate 2 and a reflecting member 40.

Such materials as polypropylene resin, polyvinyl chloride resin, ABS resin and polycarbonate resin can be used as the materials of the reflecting members 40. Since the sound absorbing plate 2 is supported by the supporting members 20*a* and 20*b*, the strength of the sound absorbing plate 2 is increased. The shapes of the reflecting members 40 may be a hollowed pipe or a solid rod.

Next, the operation thereof will be described. The resonance frequency $f_0$ of the input sound 81 is determined mainly in accordance with the thickness 11*a* of the back air spaces 11. The resonance frequency $f_0$ of the input sound 82 is also determined mainly in accordance with the thickness 12*a* of the back air spaces 12. The sound absorption coefficients respectively become maximum at the resonance frequencies $f_0$ of them. Since each sound absorbing mechanism is independent of the other, the total sound absorption characteristic is the sum of respective sound absorption characteristics. Since the back air spaces 11 are separated by the supporting members 20*a* and 20*b* and the back air spaces 12 are separated by the resonators 30 and the supporting members 20*b* respectively, each back air space 11 and each back air space 12 respectively operate independently as described in the embodiment 1, and thereby it becomes easy to generate resonance phenomena, which brings about the improvement of the sound absorption performance thereof. Since the interference of sound waves due to phase differences is thus little, the present sound absorbing mechanism has larger sound absorption coefficients as compared with those of the prior arts 1 and 2. Furthermore, many sounds do not pass through the sound absorbing plate 2 but are reflected on the surface thereof in the case where the sound absorbing coefficient thereof is small. Accordingly, when the reflecting members 40 are placed so as to be opposed to the sound absorbing plate 2, the reflected sounds are reflected by the reflecting members 40 again and are input into the sound absorbing plate 2 as the re-input sounds 81*a*, 81*b* and 82*b* to be absorbed by it. Because sounds having a shorter wavelength become re-input sounds 81*a*, 81*b* and 82*b* more efficiently, the sound absorption coefficients at frequencies higher than the resonance frequency $f_0$ are increased, and thereby sound absorption coefficients can be improved from lower frequencies to higher frequencies as compared with those of the prior arts 1 to 3.

In FIGS. 10, 11 and 12, the embodiment 6 has latticed supporting members 20*a* and 20*b*, but the present invention comprises the use of the supporting members 20*a* alone or the supporting members 20*b* alone. By such usage, a part of the effects of the present embodiment can be obtained.

Embodiment 7

Figure 13:
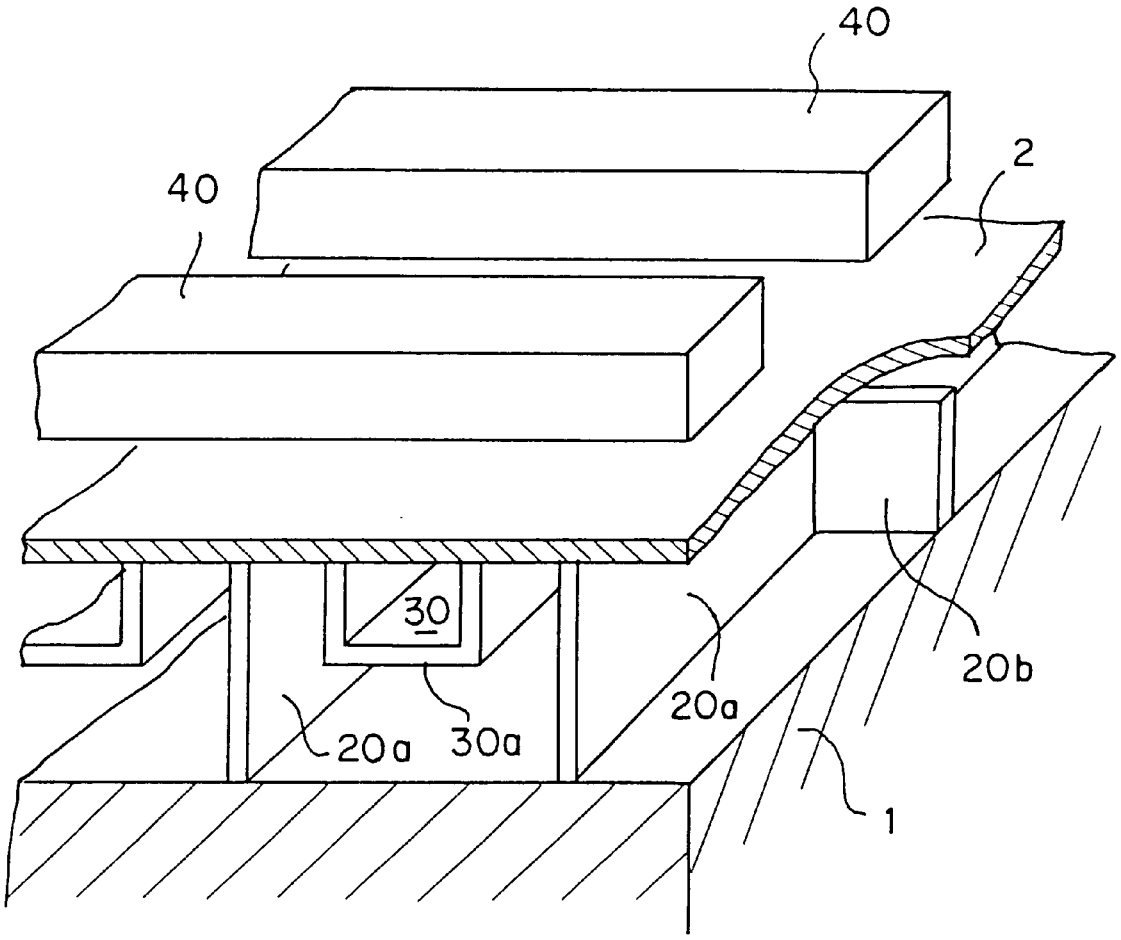
FIG. 13 is a perspective view showing the construction of a sound absorbing mechanism using a porous material according to the embodiment 7 of the present invention.
Figure 14:
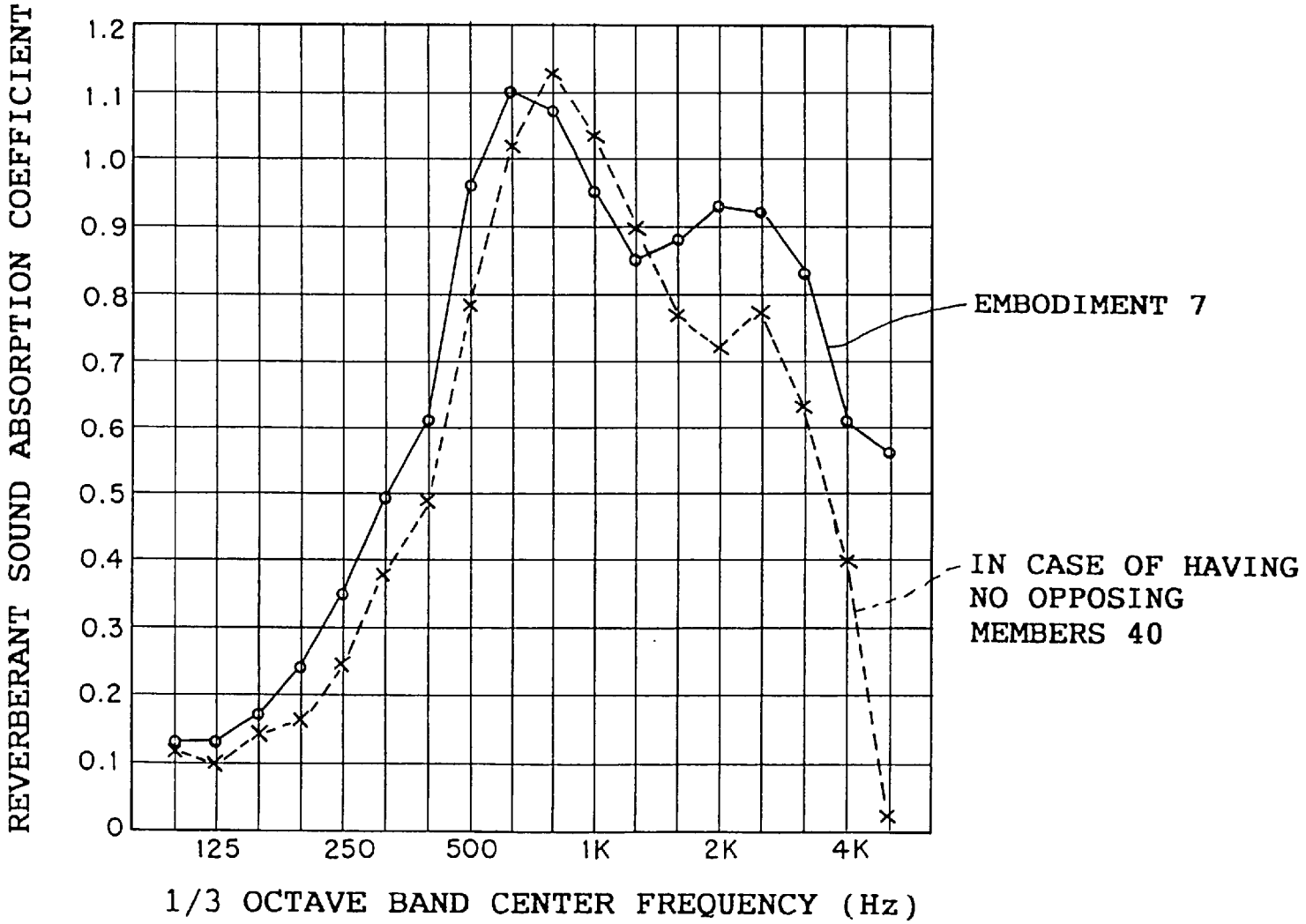
FIG. 14 is a sound absorption characteristic diagram of a sound absorbing mechanism using a porous material according to the embodiment 7 of the present invention in conformity with the method for measurement of sound absorption coefficients in a reverberation room.
Figure 15:
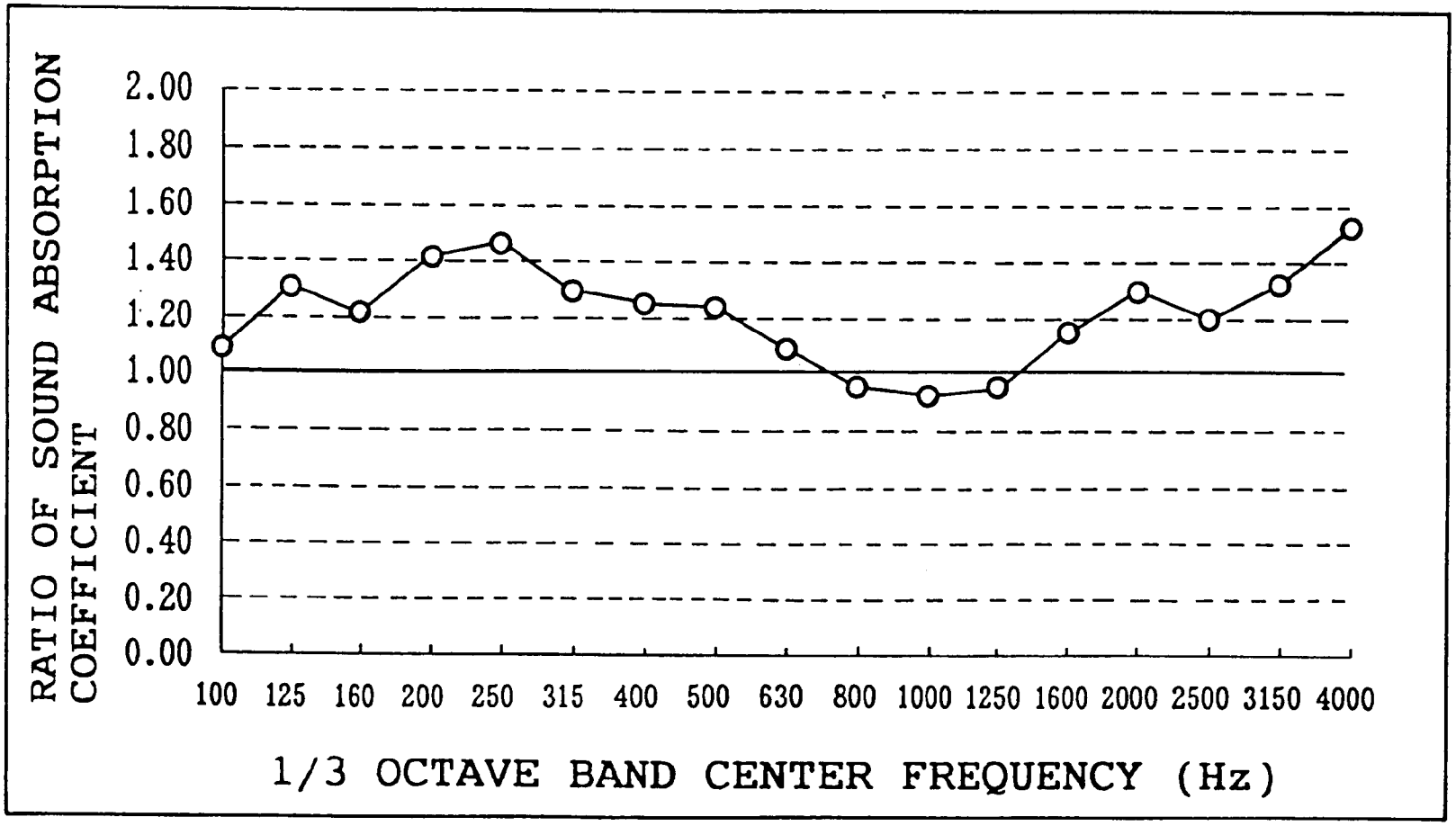
FIG. 15 is a characteristic diagram showing an effect of a sound absorbing mechanism using a porous material according to the embodiment 7 of the present invention.

FIG. 13 is a perspective view showing the construction of a sound absorbing mechanism using a porous material according to a seventh embodiment (embodiment 7) of the present invention; FIG. 14 is a sound absorption characteristic diagram in conformity with the method for measurement of sound absorption coefficients in a reverberation room; and FIG. 15 is a characteristic diagram showing an effect of the reflecting members 40. FIG. 15 shows the ratios of the sound absorption coefficients in the case where the sound absorbing mechanism shown in FIG. 13 is equipped with the reflecting members 40 to the sound absorption coefficients in the case where the sound absorbing mechanism is not equipped with the reflecting members 40. The reflecting members 40 are opposed to the top surface of the sound absorbing plate 2, and disposed to be crossed with the resonators 30 perpendicularly. The dispositions of the reflecting members 40 shown in FIGS. 10 to 13 also bring about the sound absorption effects shown in FIGS. 14 and 15 basically. The directions of the dispositions of the reflecting members 40 to the resonators 30 are not limited to the shown perpendicular and parallel directions, but they may be arbitrary. And, similar sound absorption effects can be obtained in the arbitrary direction dispositions.

Next, the operation thereof will be described. The sound absorbing mechanism is constructed by placing, for example, a sound absorbing plate 2 having the thickness of 3.5 mm so that the thickness 11*a* of the back air spaces 11 becomes about 35 mm, to which sound absorbing plate 2 hollow members 30*a* are fixed so that the thickness 12*a* of the back air spaces 12 becomes about 9 mm for forming the resonators 30. And then, square pipes made from ABS resin and having the width of about 33 mm and the height of about 15 mm are disposed with the space of about 10 mm from the sound absorbing plate 2 as the reflecting members 40. The sound absorption characteristic of the sound absorbing mechanism thus constructed is improved in the sound absorption coefficients at frequencies higher than about 1.5 kilo-Hz owing to the effect of reflection and at frequencies lower than about 600 Hz owing to the effect of slit resonation phenomena as compared to the sound absorption characteristic in case of having no reflecting members, and the former is totally improved at a wider frequency band, as shown in FIGS. 14 and 15. According to the results of some experiments, sound absorption coefficients are furthermore improved at the thickness 12*a* of the back air spaces 12 being about 15 mm and at the space between the reflecting members 40 and the sound absorbing plate 2 being 15 mm.

Embodiment 8

Figure 16:
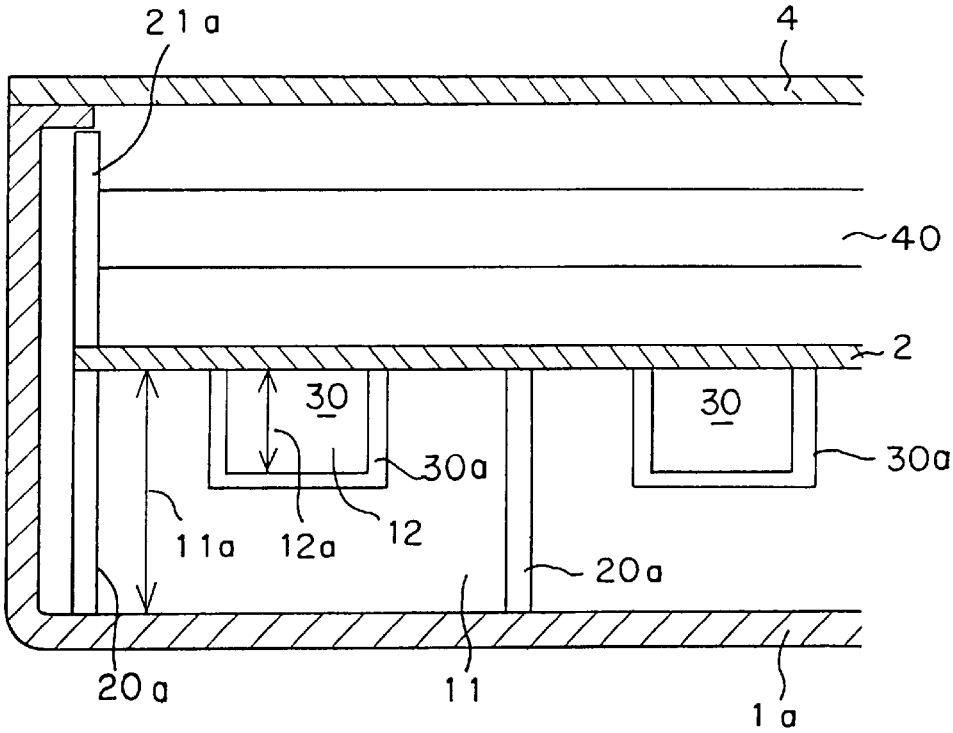
FIG. 16 is a longitudinal sectional view showing the construction of a sound absorbing panel using a porous material according to the embodiment 8 of the present invention.

FIG. 16 is a longitudinal sectional view showing the construction of a sound absorbing panel using a porous material according to a eighth embodiment (embodiment 8) of the present invention. In FIG. 16, reference numeral 1*a* designates a sound insulating plate also serving as a housing of the sound absorbing panel. Reference numeral 4 designates a protecting plate made of a punching metal or the like, which protecting plate 4 has at least one opening and is fixed to the insulating plate 1*a* so as to cover the opened part of the sound insulating plate 1*a*. Reference numeral 21*a* designates a supporting member for disposing the reflecting members 40. The directions of the reflecting members 40 may be parallel or perpendicular to the resonators 30. This sound absorbing panel has the same effects as those of the embodiments 6 and 7.

Embodiment 9

Figure 17:
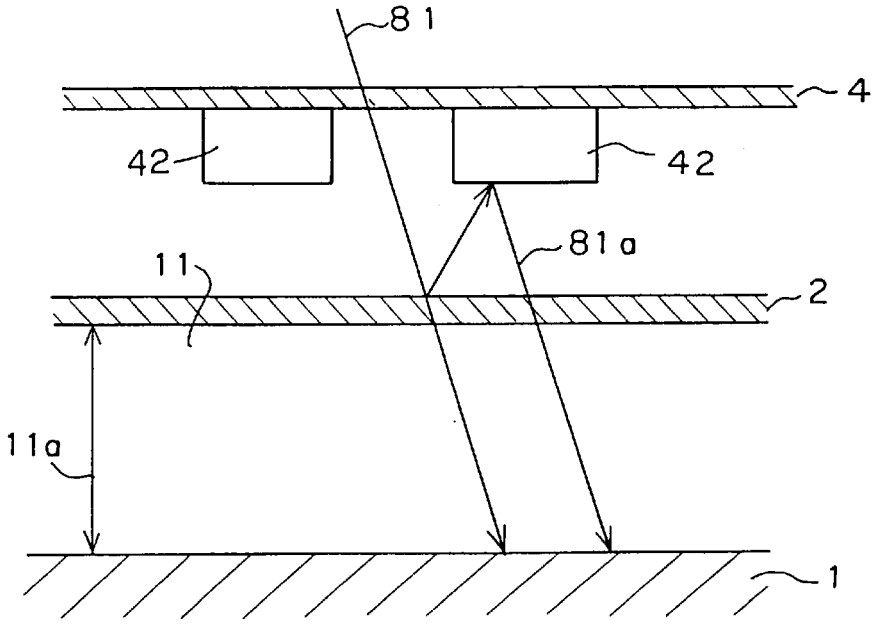
FIG. 17 is a longitudinal sectional view showing the construction of a sound absorbing mechanism using a porous material according to the embodiment 9 of the present invention.

FIG. 17 is a longitudinal sectional view showing the construction of a sound absorbing mechanism using a porous material according to a ninth embodiment (embodiment 9) of the present invention. In FIG. 17, reference numeral 1 designates a sound insulator such as a wall. Reference numeral 2 designates a sound absorbing plate similar to that of the embodiment 1; and numeral 4 designates a protecting plate made of a punching metal or the like, which protecting plate 4 has at least one opening and is disposed so as to be opposed to the top surface of the sound absorbing plate 2. Reference numeral 11 designates the back air space of the sound absorbing plate 2; and numeral 11*a* designates the thickness of the back air space 11. Reference numeral 42 designates plural reflecting members fixed to the protecting plate 4 and disposed in front of the sound absorbing plate 2 with a space from the sound absorbing plate 2. Reference numeral 81 designates an input sound into the back air space 11; and numeral 81*a* designates a re-input sound into the back air space 11 which re-input sound 81*a* is the input sound 81 having been reflected by the sound absorbing plate 2 and a reflecting member 42.

Such materials as polypropylene resin, polyvinyl chloride resin, ABS resin and polycarbonate resin can be used as the material of the sound absorbing plate 2. The shapes of the reflecting members 42 may be a hollowed pipe or a solid rod.

Next, the operation thereof will be described. The resonance frequency $f_0$ of the input sound 81 is determined in accordance with the thickness 11*a* of the back air space 11. Sound absorption coefficients become maximum at the resonance frequency $f_0$. Many sounds do not pass through the sound absorbing plate 2 but are reflected on the surface thereof in the case where the sound absorbing coefficient thereof is small. Accordingly, when the reflecting members 42 are placed so as to be opposed to the sound absorbing plate 2, the reflected sound is reflected by a reflecting member 42 again and is input into the sound absorbing plate 2 as the re-input sound 81*a* to be absorbed by it. Because sounds having a shorter wavelength become re-input sounds 81*a* more efficiently, the sound absorption coefficients at frequencies higher than the resonance frequency $f_0$ are increased, and thereby sound absorption coefficients can be improved from lower frequencies to higher frequencies as compared with those of the prior art 1. Besides, the damage of the sound absorbing plate 2 can be prevented by the protecting plate 4. Since the reflecting members 42 are fixed to the protecting plate 4 in advance, the efficiency of fitting operation of the protecting plate 4 at fitting sites is high. The reflecting members 42 serves also as a reinforcement material of the protecting plate 4.

Embodiment 10

Figure 18:
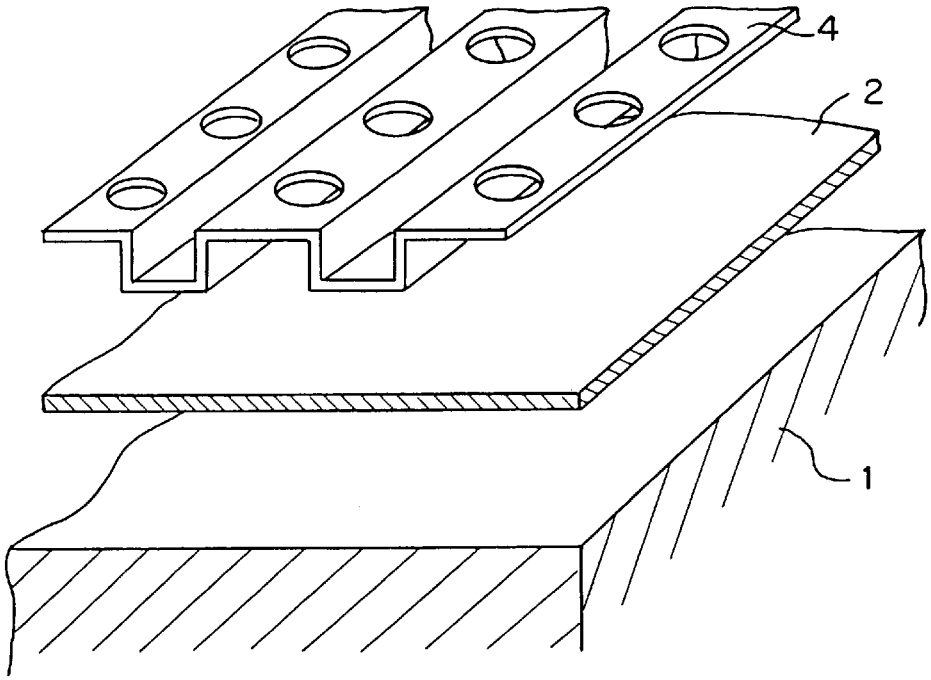
FIG. 18 is a perspective view showing the construction of a sound absorbing mechanism using a porous material according to the embodiment 10 of the present invention.
Figure 19:
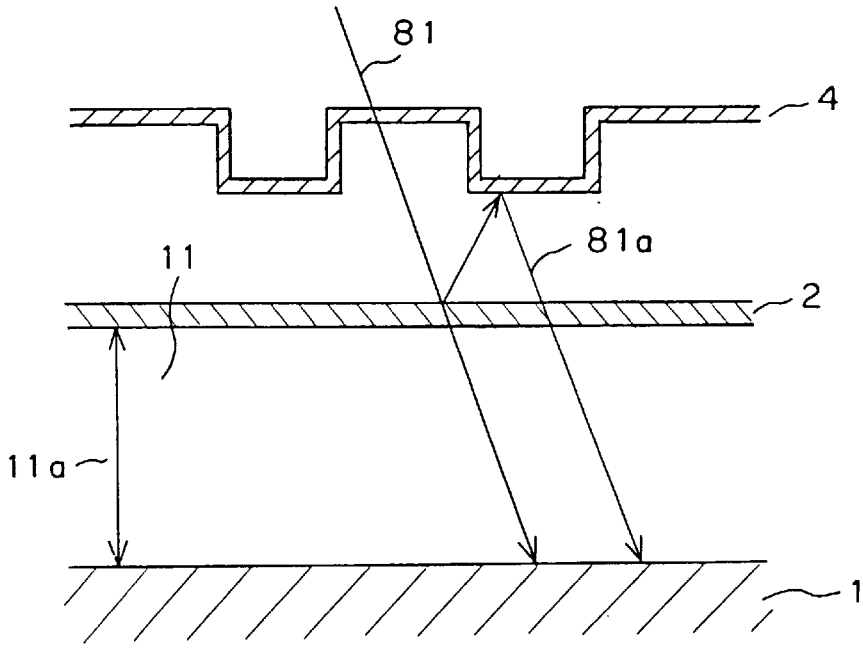
FIG. 19 is a longitudinal sectional view showing the construction of a sound absorbing mechanism using a porous material according to the embodiment 10 of the present invention.

FIG. 18 is a perspective view showing the construction of a sound absorbing mechanism using a porous material according to a tenth embodiment (embodiment 10) of the present invention; and FIG. 19 is a longitudinal sectional view showing the sound absorbing mechanism using a porous material shown in FIG. 18. In FIGS. 18 and 19, reference numeral 4 designates a protecting plate made of a punching metal or the like, which protecting plate 4 is formed by bending its portions corresponding to the reflecting members 42 described in the embodiment 9 and has openings in the portions other than the portions corresponding to the reflecting members 42 and furthermore is disposed so as to be opposed to the top surface of the sound absorbing plate 2.

The sound absorbing mechanism thus constructed has also the same effects as those of the embodiment 9.

Embodiment 11

Figure 20:
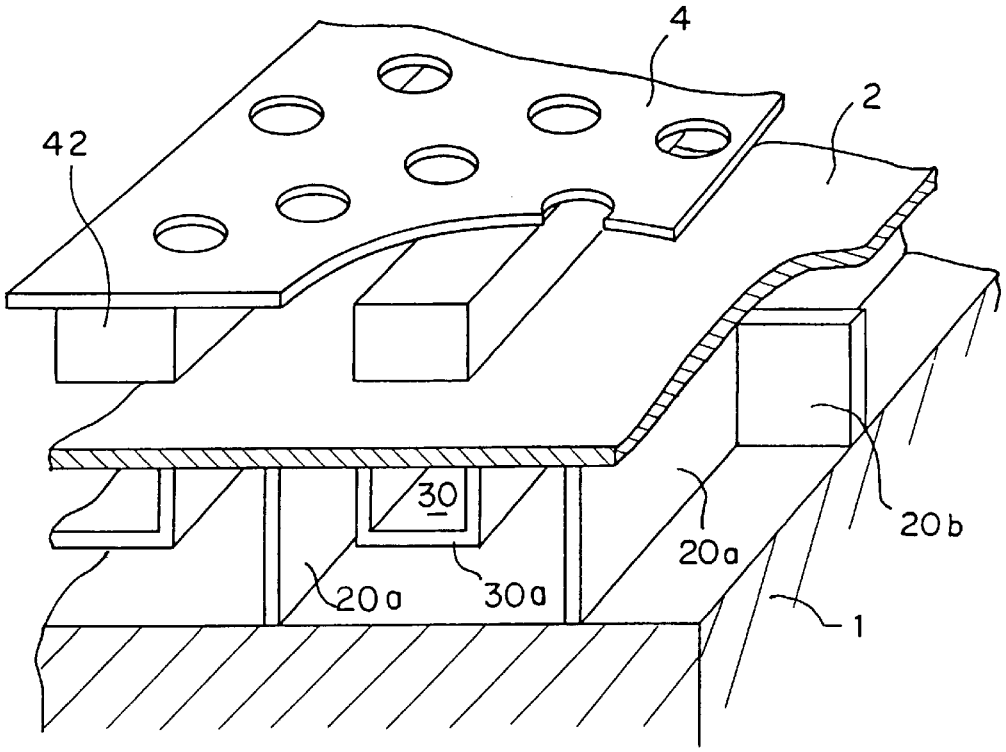
FIG. 20 is a perspective view showing the construction of a sound absorbing mechanism using a porous material according to the embodiment 11 of the present invention.
Figure 21:
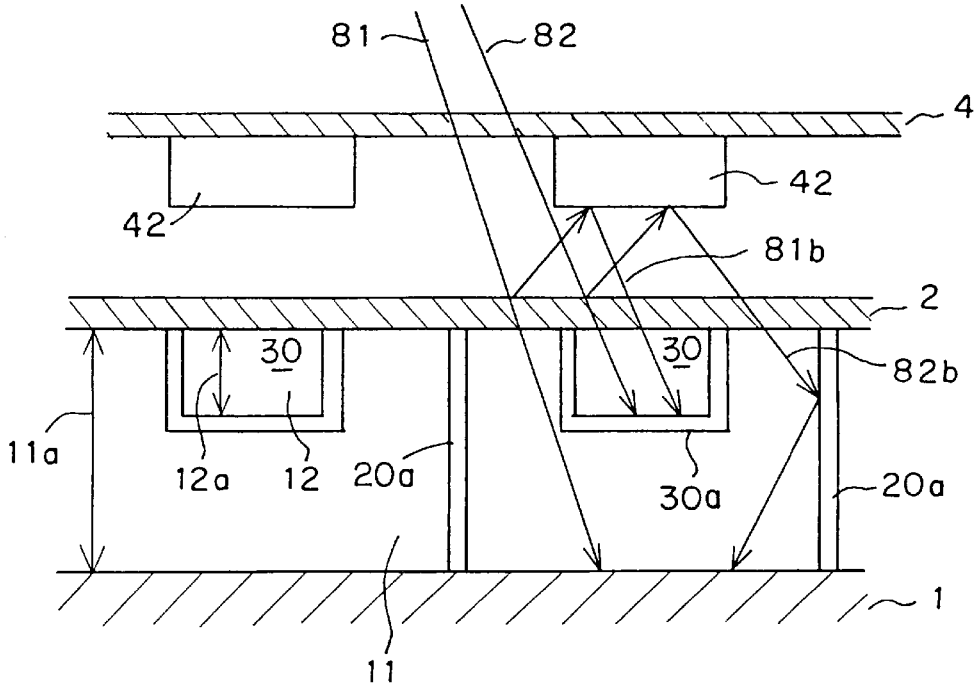
FIG. 21 is a longitudinal sectional view showing the construction of a sound absorbing mechanism using a porous material according to the embodiment 11 of the present invention.

FIG. 20 is a perspective view showing the construction of a sound absorbing mechanism using a porous material according to a eleventh embodiment (embodiment 11) of the present invention; and FIG. 21 is a longitudinal sectional view showing the sound absorbing mechanism using a porous material of FIG. 20. In FIGS. 20 and 21, reference numeral 1 designates a sound insulator such as a wall. Reference numeral 2 designates a sound absorbing plate similar to that of the embodiment 1; and reference numeral 4 designates a protecting plate made of a punching metal or the like, which protecting plate has openings and is disposed in front of the sound absorbing plate 2. Reference numerals 11 and 12 designate back air spaces of the sound absorbing plate 2; and numerals 11*a* and 12*a* designate respective thicknesses of the back air spaces 11 and 12. Reference numerals 20*a* and 20*b* designate latticed supporting members for supporting the sound absorbing plate 2 so as to be opposed to the sound insulator 1 above the sound insulator 1 with the space of the thickness 11*a* of the back air spaces 11. Reference numeral 30 designates resonators equipped to the insulator 1 side of the sound absorbing plate 2 with the space of the thickness 12*a* of the back air spaces 12; and numeral 30*a* designates hollow members for forming the resonators 30. The resonators 30 are disposed so as to be parallel to the supporting members 20*a* and perpendicular to the supporting members 20*b*. Reference numeral 42 designates plural reflecting members fixed to the protecting plate 4, and disposed so as to be opposed to the sound absorbing plate 2 and parallel to the resonators 30. Reference numeral 81 designates an input sound into a back air space 11; numeral 81*b* designates a re-input sound into a back air space 12 which re-input sound 81*b* is the input sound 81 having been reflected by the sound absorbing plate 2 and a reflecting member 42; numeral 82 designates an input sound into a back air space 12; and numeral 82*b* designates a re-input sound into a back air space 11 which re-input sound 82*b* is the input sound 82 having been reflected by the sound absorbing plate 2 and a reflecting member 42.

Such materials as polypropylene resin, polyvinyl chloride resin, ABS resin and polycarbonate resin can be used as the material of the sound absorbing plate 2. Since the sound absorbing plate 2 is supported by the supporting members 20*a* and 20*b*, the strength of the sound absorbing plate 2 is increased. The shapes of the reflecting members 42 may be a hollowed pipe or a solid rod.

Next, the operation thereof will be described. The resonance frequency $f_0$ of the input sound 81 is determined mainly in accordance with the thickness 11*a* of the back air spaces 11. The resonance frequency $f_0$ of the input sound 82 is also determined mainly in accordance with the thickness 12*a* of the back air spaces 12. Sound absorption coefficients respectively become maximum at the resonance frequencies $f_0$ of them. Since each sound absorbing mechanism is independent of the other, the total sound absorption characteristic is the sum of the respective sound absorption characteristics. Since the back air spaces 11 are separated by the supporting members 20*a* and 20*b* and the back air spaces 12 are separated by the resonators 30 and the supporting members 20*b* respectively, each back air space 11 and each back air space 12 respectively operate independently as described in the embodiment 1, and thereby it becomes easy to generate resonance phenomena, which brings about the improvement of the sound absorption performance thereof. Since the interference of sound waves due to phase differences is thus little, the present sound absorbing mechanism has larger sound absorption coefficients as compared with those of the prior arts 1 and 2. Furthermore, many sounds do not pass through the sound absorbing plate 2 but are reflected on the surface thereof in the case where the sound absorbing coefficient thereof is small, as described in the embodiment 2. Accordingly, when the reflecting members 42 are placed so as to be opposed to the sound absorbing plate 2, the reflected sounds are reflected by the reflecting members 42 again and are input into the sound absorbing plate 2 as the re-input sounds 81*b* and 82*b* to be absorbed by it. Because sounds having a shorter wavelength become re-input sounds 81*a* and 82*b* more efficiently, sound absorption coefficients at frequencies higher than-the resonance frequency $f_0$ are increased, and thereby sound absorption coefficients can be improved from lower frequencies to higher frequencies as compared with those of the prior arts 1 to 3. Besides, the damage of the sound absorbing plate 2 can be prevented by the protecting plate 4. Since the reflecting members 42 are fixed to the protecting plate 4 in advance, the reflecting members 42 also serves as reinforcement materials of the protecting plate 4, and the efficiency of fitting operation of the protecting plate 4 at fitting sites is high.

In FIGS. 20 and 21, the embodiment 11 has latticed supporting members 20*a* and 20*b*, but the present invention comprises the use of the supporting members 20*a* alone or the supporting members 20*b* alone. By such usage, a part of the effects of the present embodiment can be obtained. The similar effects can be expected in the case where the reflecting members 42 are disposed perpendicularly to the resonators 30.

Embodiment 12

Figure 22:
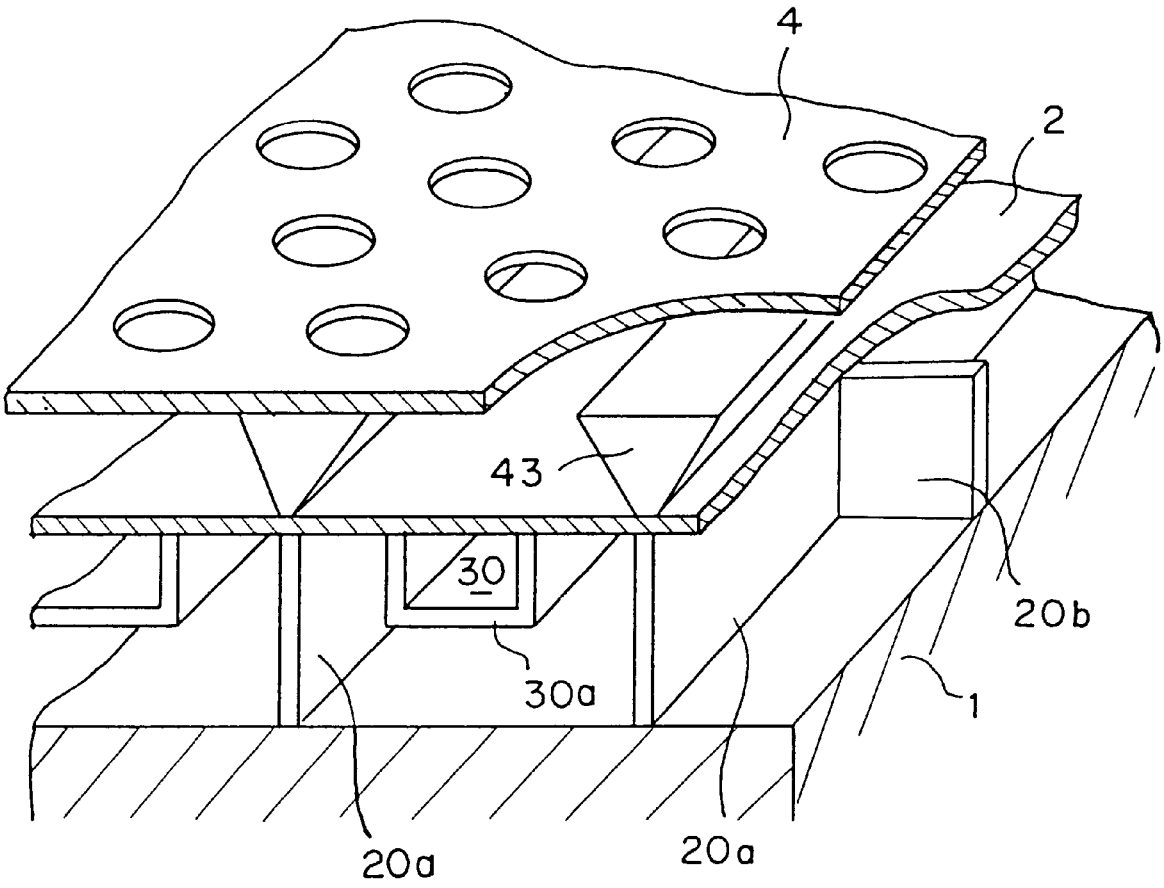
FIG. 22 is a perspective view showing the construction of a sound absorbing mechanism using a porous material according to the embodiment 12 of the present invention.
Figure 23:
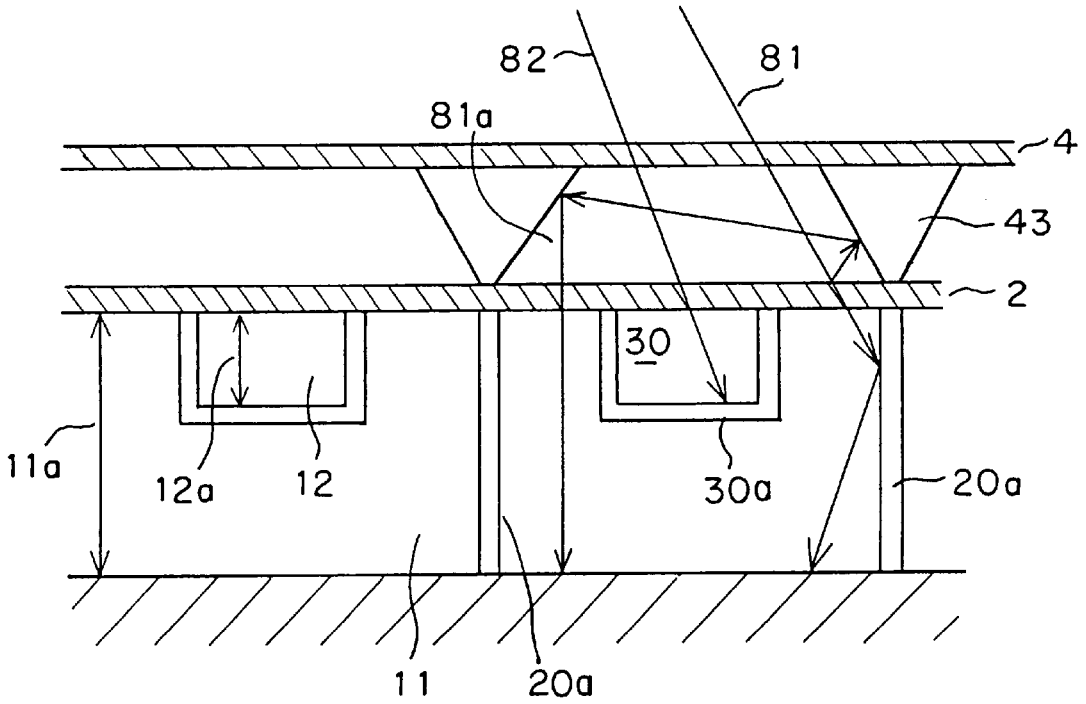
FIG. 23 is a longitudinal sectional view showing the construction of a sound absorbing mechanism using a porous material according to the embodiment 12 of the present invention.

FIG. 22 is a perspective view showing the construction of a sound absorbing mechanism using a porous material according to a twelfth embodiment (embodiment 12) of the present invention; and FIG. 23 is a longitudinal sectional view showing the sound absorbing mechanism using a porous material shown in FIG. 22. In FIGS. 22 and 23, reference numeral 43 designates plural reflecting members fixed to the protecting plate 4 and disposed so that the sound absorbing plate 2 is put between the reflecting members 43 and the supporting members 20*a* or 20*b*. Reference numeral 81*a* designates a re-input sound into a back air space 11 which re-input sound 81*a* is the input sound 81 having been reflected by the sound absorbing plate 2 and reflecting members 43.

Since the sound absorbing mechanism using a porous material of the embodiment 12 is thus constructed, it can improve sound absorption coefficients similarly in the embodiment 11, and it can not only prevent the damage of the sound absorbing plate 2 but also increase the strength of the sound absorbing plate 2.

Embodiment 13

Figure 24:
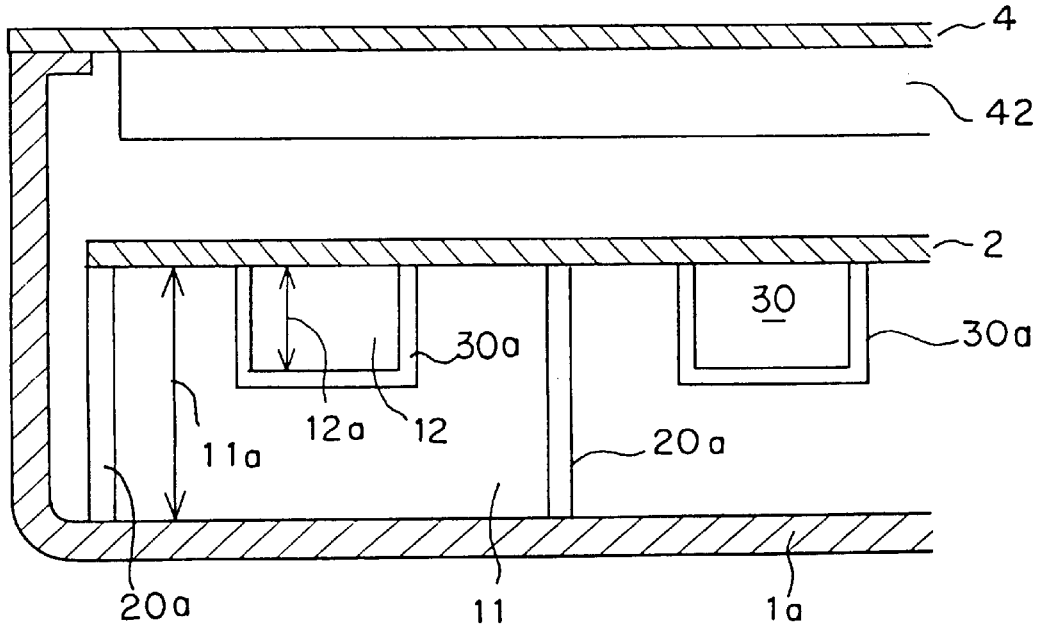
FIG. 24 is a longitudinal sectional view showing the construction of a sound absorbing panel using a porous material according to the embodiment 13 of the present invention.
Figure 25:
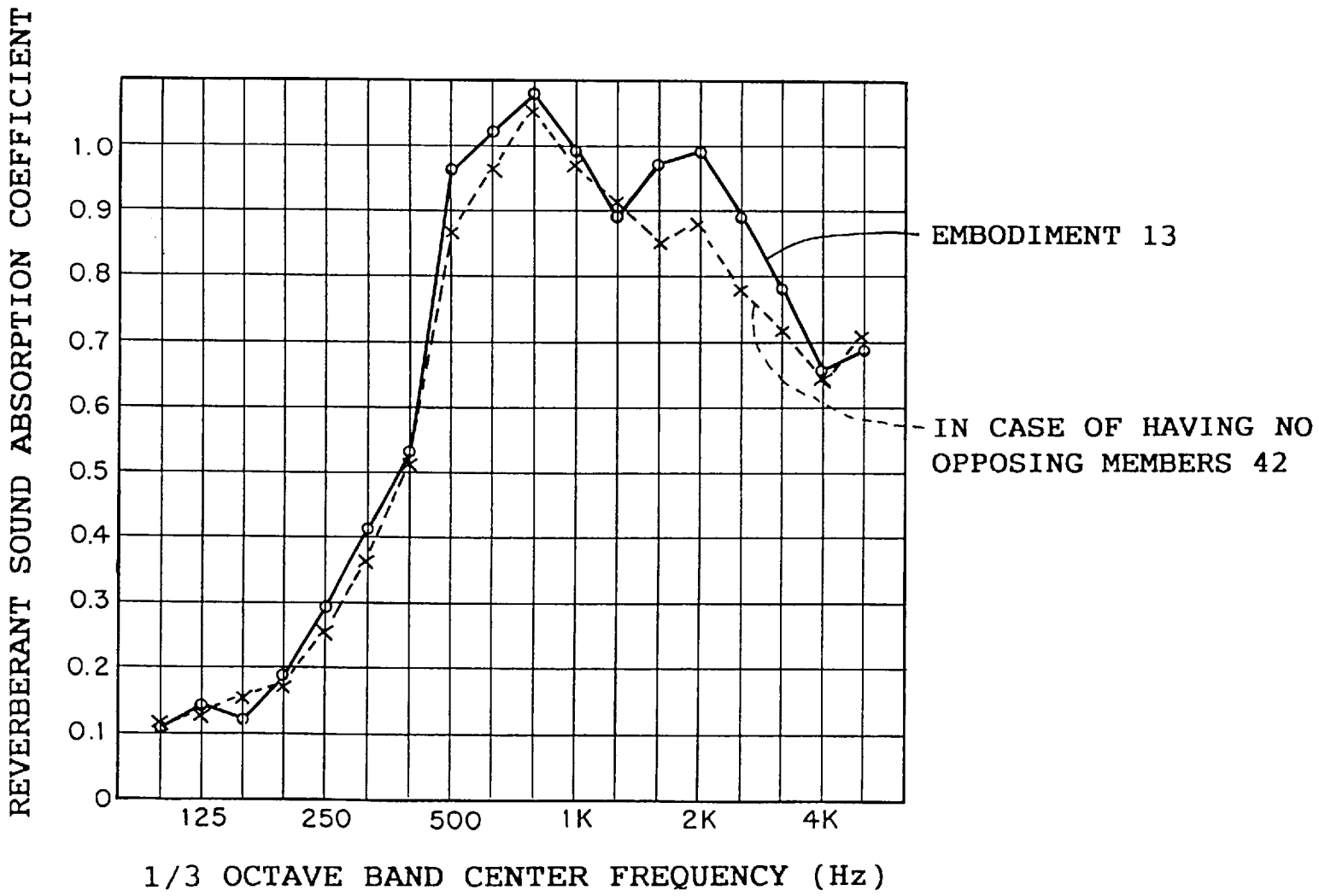
FIG. 25 is a sound absorption characteristic diagram of a sound absorbing panel using a porous material according to the embodiment 13 of the present invention in conformity with the method for measurement of sound absorption coefficients in a reverberation room.

FIG. 24 is a longitudinal sectional view showing the construction of a sound absorbing panel using a porous material according to a thirteenth embodiment (embodiment 13) of the present invention; and FIG. 25 is a sound absorption characteristic diagram in conformity with the method for measurement of sound absorption coefficients in a reverberation room. In FIG. 24, reference numeral 1*a* designates a sound insulating plate also serving as a housing of the sound absorbing panel. Reference numeral 4 designates a protecting plate made of a punching metal or the like, which protecting plate 4 has at least one opening and is fixed to the sound insulating plate 1*a* so as to cover the opened part of the sound insulating plate 1*a*. Reference numeral 42 designates plural reflecting members fixed to the protecting plate 4 and disposed so as to be opposed to the sound absorbing plate 2. The reflecting members 42 are disposed to be perpendicular to the resonators 30.

Next, the operation thereof will be described. Since the back air spaces 11 are separated by the supporting members 20*a* and 20*b* and the back air spaces 12 are separated by the hollow members 30*a* and the supporting members 20*b* respectively, each back air space 11 and each back air space 12 respectively operate independently as described in the embodiment 1, and thereby it becomes easy to generate resonance phenomena, which brings about the improvement of the sound absorption performance thereof. Since the interference of sound waves due to phase differences is thus little, the present sound absorbing panel has larger sound absorption coefficients as compared with those of the prior arts 1 and 2. Furthermore, many sounds do not pass through the sound absorbing plate 2 but are reflected on the surface thereof in the case where the sound absorbing coefficient thereof is small. Accordingly, when the reflecting members 42 are placed so as to be opposed to the sound absorbing plate 2, the reflected sounds are reflected by the reflecting members 42 again and are input into the sound absorbing plate 2 again to be absorbed by it. Because sounds having a shorter wavelength are input more efficiently, sound absorption coefficients at frequencies higher than the resonance frequency $f_0$ are increased, and thereby sound absorption coefficients can be improved from lower frequencies to higher frequencies as compared with those of the prior arts 1 to 3.

The sound absorbing panel is constructed by forming, for example, a galvanized steel plate having the thickness of 1.6 mm into a box sized to be about 500 mm×1960 mm×50 mm as the sound insulating plate 1*a,* and by placing the sound absorbing plate 2 having the thickness of about 3.5 mm in the box so that the thickness 11*a* of the back air spaces 11 becomes about 35 mm, to which sound absorbing plate 2 the hollow members 30*a* are fixed so that the thickness 12*a* of the back air spaces 12 becomes about 9 mm for forming the resonators 30. And then, square bars made from ABS resin and having the width of about 27 mm and the height of about 15 mm are fixed to the protecting plate 4 made of an aluminum plate having the thickness of 0.8 mm and the rate of opened area of about 40% as the reflecting members 40. And then, the protecting plate 4 is fixed to the sound insulating plate 1*a*. The sound absorption characteristic of the sound absorbing panel thus constructed is improved in the sound absorption coefficients at frequencies higher than about 1.5 kilo-Hz as compared to the sound absorption characteristic in case of having no reflecting members, and the former is totally improved at a wider frequency band, as shown in FIG. 25.

Similar effects can be expected in the case where the reflecting members 42 are disposed to be parallel to the resonators 30.

Embodiment 14

Figure 26:
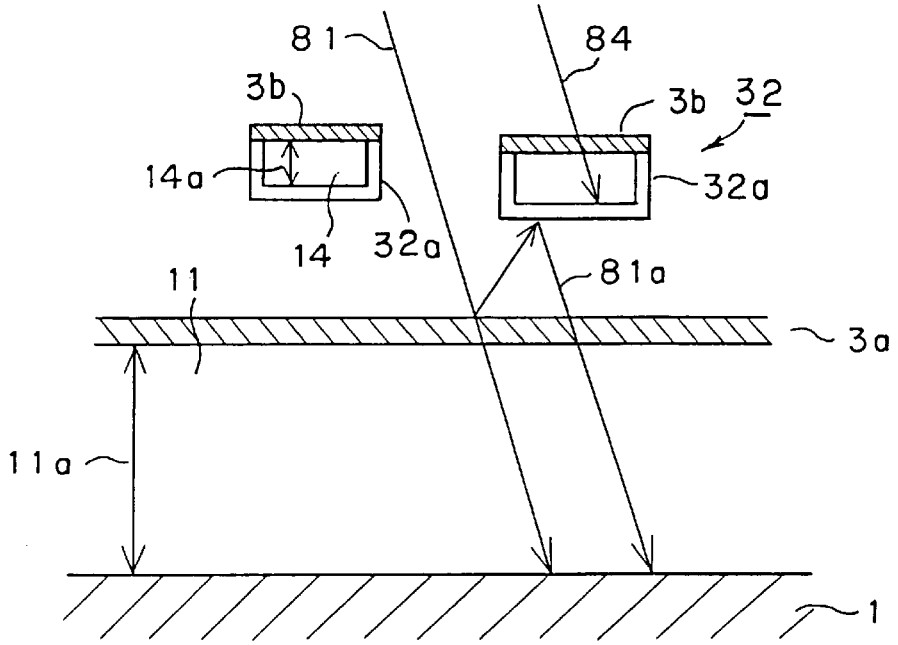
FIG. 26 is a longitudinal sectional view showing the construction of a sound absorbing mechanism using a porous material according to the embodiment 14 of the present invention.
Figure 27:
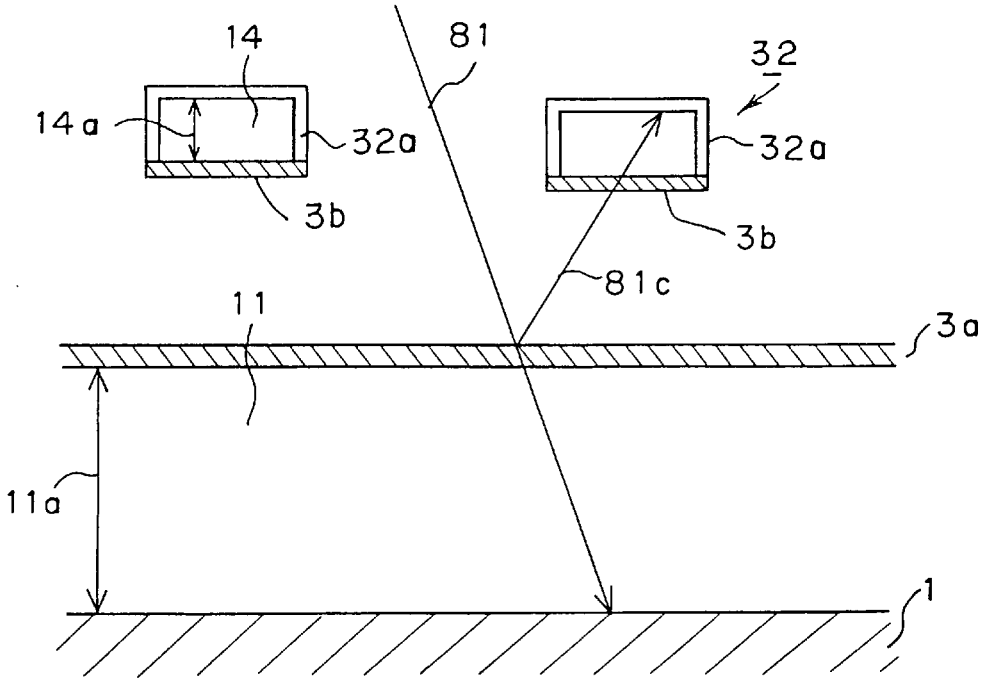
FIG. 27 is a longitudinal sectional view showing the construction of a sound absorbing mechanism using a porous material according to the embodiment 14 of the present invention.
Figure 28:
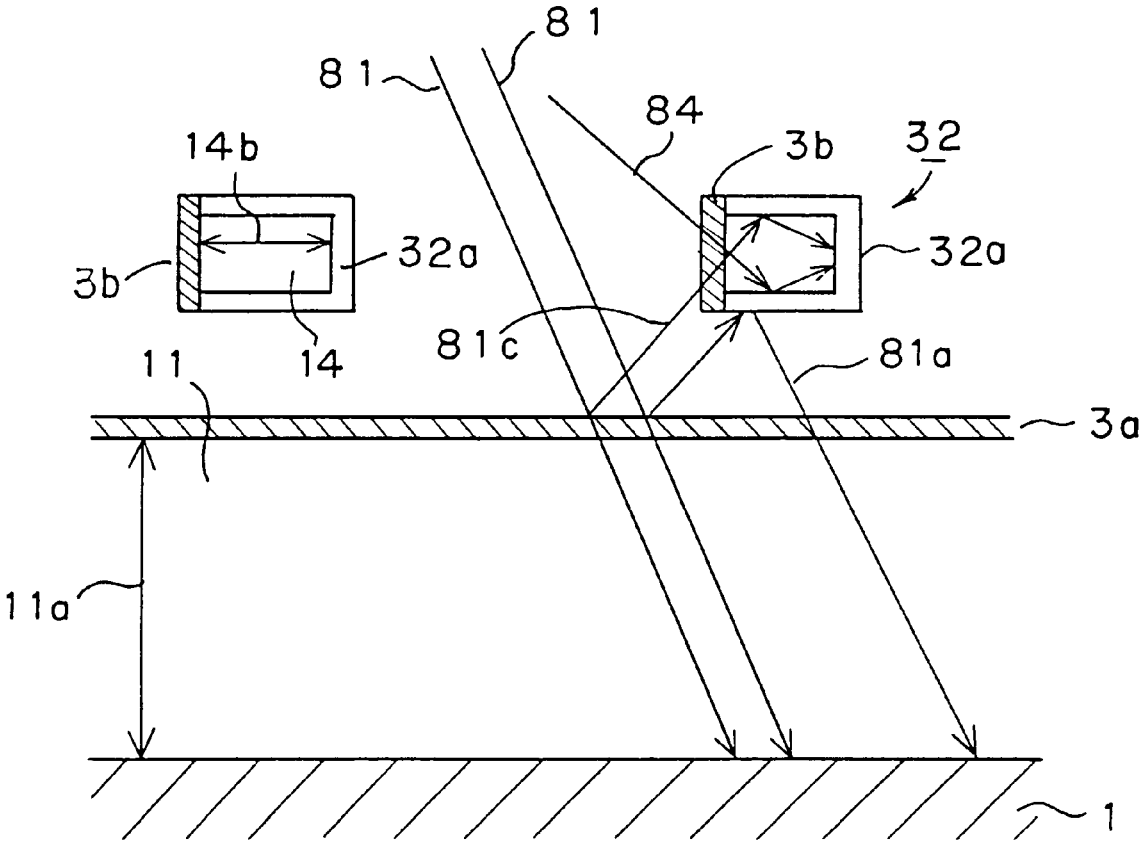
FIG. 28 is a longitudinal sectional view showing the construction of a sound absorbing mechanism using a porous material according to the embodiment 14 of the present invention.

FIGS. 26, 27 and 28 are longitudinal sectional views showing the construction of a sound absorbing mechanism using a porous material according to a fourteenth embodiment (embodiment 14) of the present invention. In FIGS. 26, 27 and 28, reference numeral 1 designates a sound insulator such as a wall. Reference numerals 3*a* and 3*b* designate sound absorbing plates using a thin plate porous material similar to the sound absorbing plate 2 of the embodiment 1. The materials of the sound absorbing plates 3*a* and 3*b* are plastic particles, a ceramic, foam metal or the like. Reference numeral 11 designates a back air space of the sound absorbing plate 3*a;* and numeral 11*a* designates the thickness of the back air space 11. Reference numeral 14 designates a back air space of the sound absorbing plates 3*b;* numeral 14*a* designates the thickness of the perpendicular direction of the back air spaces 14; and numeral 14*b* designates the thickness of the horizontal direction of the back air spaces 14. Reference numeral 32 designates plural increased sound absorbers composed of a sound absorbing plate 3*b* and a hollow member 32*a* and disposed in front of the sound absorbing plate 3*a* so as to be opposed to the sound absorbing plate 3*a* with a space. Reference numeral 81 designates an input sound into the back air space 11; numeral 81*a* designates a re-input sound into the back air space 11 which re-input sound 81*a* is the input sound 81 having been reflected by the sound absorbing plate 3*a* and an increased sound absorber 32; and numeral 81*c* designates a re-input sound into a back air space 14 which re-input sound 81*c* is the input sound 81 having been reflected by the sound absorbing plate 3*a*. Reference numeral 84 designates an input sound into a back air space 14.

Next, the operation thereof will be described. The resonance frequency $f_0$ of the input sound 81 is determined in accordance with the thickness 11*a* of the back air space 11. The resonance frequency $f_0$ of the input sound 84 is also determined in accordance with the thickness 14*a* or 14*b* of the back air spaces 14. Sound absorption coefficients respectively become maximum at the resonance frequencies $f_0$ of them. Since each sound absorbing mechanism is independent of each other, the total sound absorption characteristic is the sum of the respective sound absorption characteristics. Many sounds do not pass through the sound absorbing plate 3*a* but are reflected on the surface thereof in the case where the sound absorbing coefficient thereof is small. Accordingly, when the increased sound absorbers 32 are disposed so as to be opposed to the sound absorbing plate 3*a*. the reflected sound becomes the re-input sound 81*c* or the re-input sound 81*a* which is the re-input sound 81*c* reflected by an increased sound absorber 32 again and is input into the sound absorbing plate 3*a* to be absorbed. Because sounds having a shorter wavelength become re-input sounds 81*a* and 81*c* more efficiently, sound absorption coefficients at frequencies higher than the resonance frequency $f_0$ are increased, and thereby sound absorption coefficients can be improved from lower frequencies to higher frequencies as compared with those of the prior art 1.

Because re-input sounds have a propagation path longer than those of input sounds, their phases are shifted. Consequently, resonance phenomena are reinforced at some frequencies, which brings about the increase of sound absorption coefficients.

Some sounds of the input sounds into the increased sound absorbers 32 are pulled into the spaces between the increased sound absorbers 32 owing to the phenomena such as diffraction. Because the impedance of them is matched and their input angles become close to be perpendicular, they are absorbed efficiently.

According to the results of some experiments, sound absorption coefficients are most improved in case of the construction shown in FIG. 26 among the constructions shown in FIGS. 26 to 28.

Embodiment 15

Figure 29:
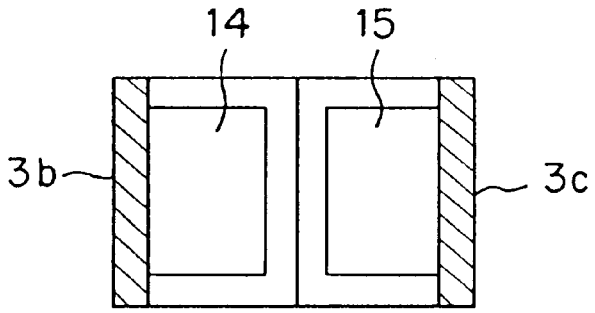
FIG. 29 is a longitudinal sectional view showing the construction of an increased sound absorber of a sound absorbing mechanism using a porous material according to the embodiment 15 of the present invention.
Figure 30:
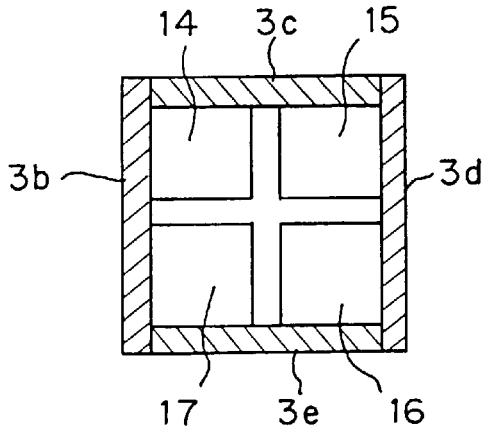
FIG. 30 is a longitudinal sectional view showing the construction of an increased sound absorber of a sound absorbing mechanism using a porous material according to the embodiment 15 of the present invention.
Figure 31:
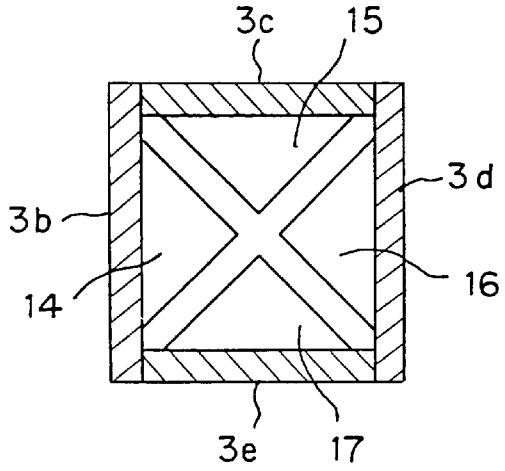
FIG. 31 is a longitudinal sectional view showing the construction of an increased sound absorber of a sound absorbing mechanism using a porous material according to the embodiment 15 of the present invention.

FIGS. 29, 30 and 31 are longitudinal sectional views showing the constructions of increased sound absorbers 32 of sound absorbing mechanisms using a porous material according to a fifteenth embodiment (embodiment 15) of the present invention respectively. In FIGS. 29, 30 and 31, reference numerals 3*b*, 3*c*, 3*d* and 3*e* designate sound absorbing plates using a thin plate porous material. The materials of the sound absorbing plates 3*b*, 3*c*, 3*d* and 3*e* are plastic particles, a ceramic, foam metal or the like. Reference numerals 14, 15, 16 and 17 designate back air spaces of the sound absorbing plates 3*b*, 3*c*, 3*d* and 3*e*. Because this embodiment separates the sound absorbing plates 3*b*, 3*c*, 3*d* and 3*e* and their back air spaces 14, 15, 16 and 17 respectively, plural resonance frequencies $f_0$ can be set, and thereby the frequencies having the local maximum sound absorption coefficient can be dispersed. Consequently, the distribution of a sound absorption coefficients having a furthermore wider frequency band can be obtained.

Embodiment 16

Figure 32:
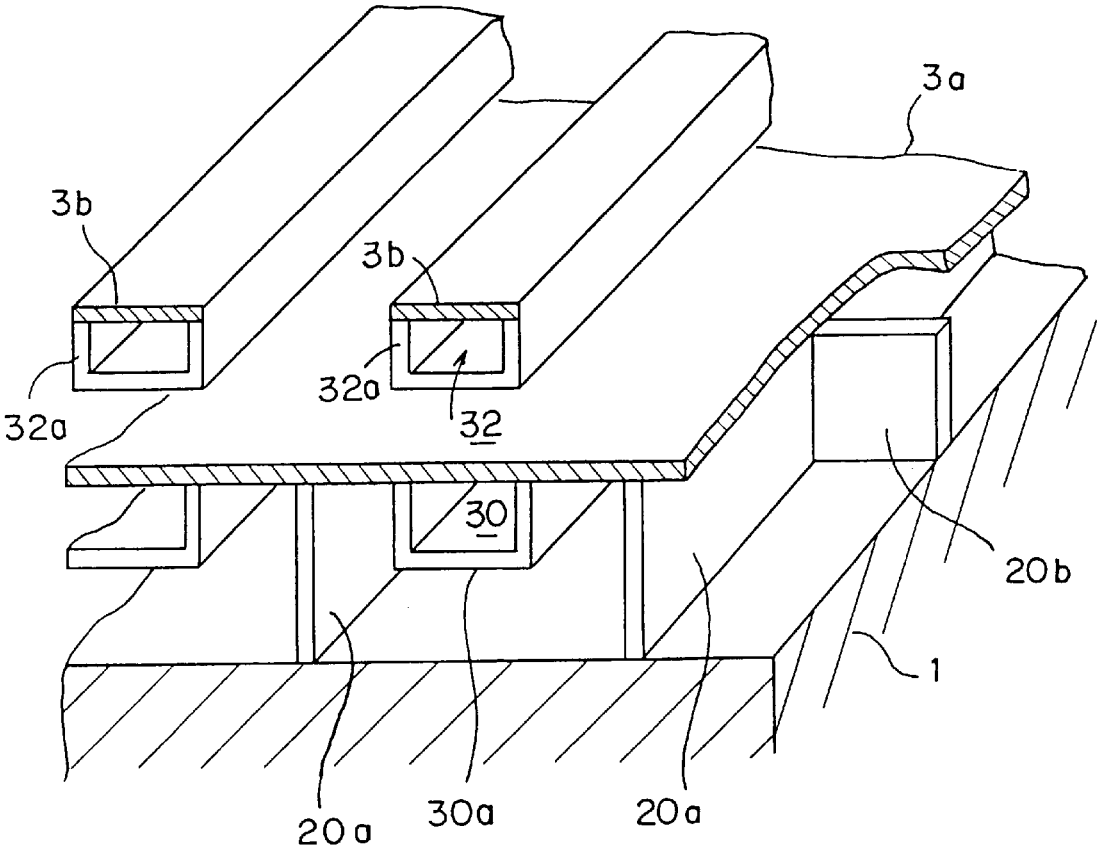
FIG. 32 is a perspective view showing the construction of a sound absorbing mechanism using a porous material according to the embodiment 16 of the present invention.
Figure 33:
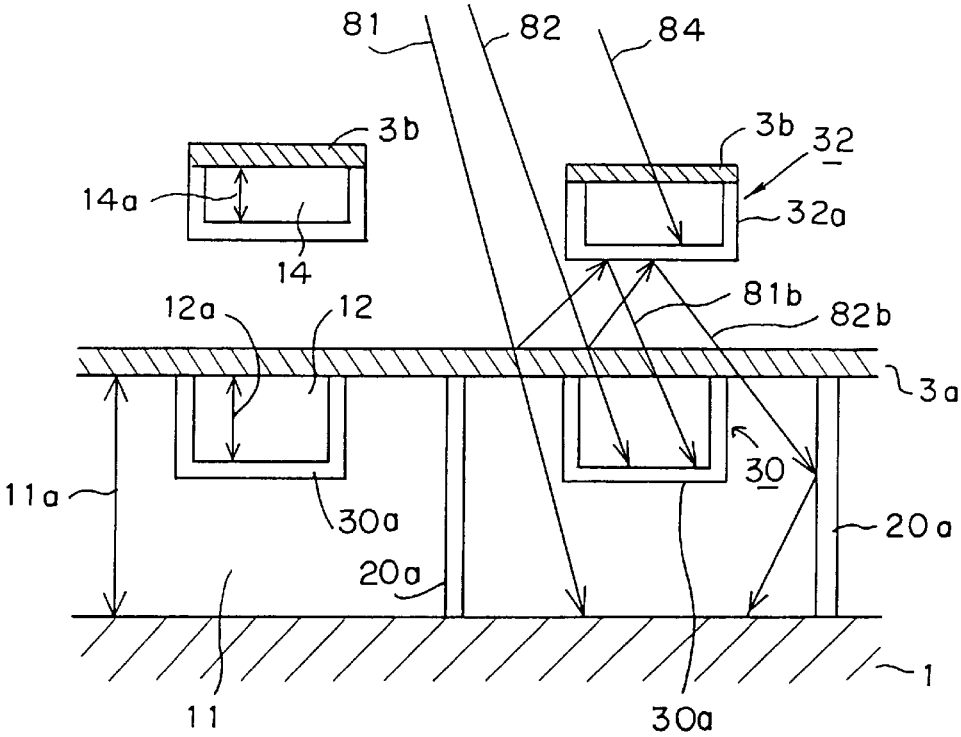
FIG. 33 is a longitudinal sectional view showing the construction of a sound absorbing mechanism using a porous material according to the embodiment 16 of the present invention.
Figure 34:
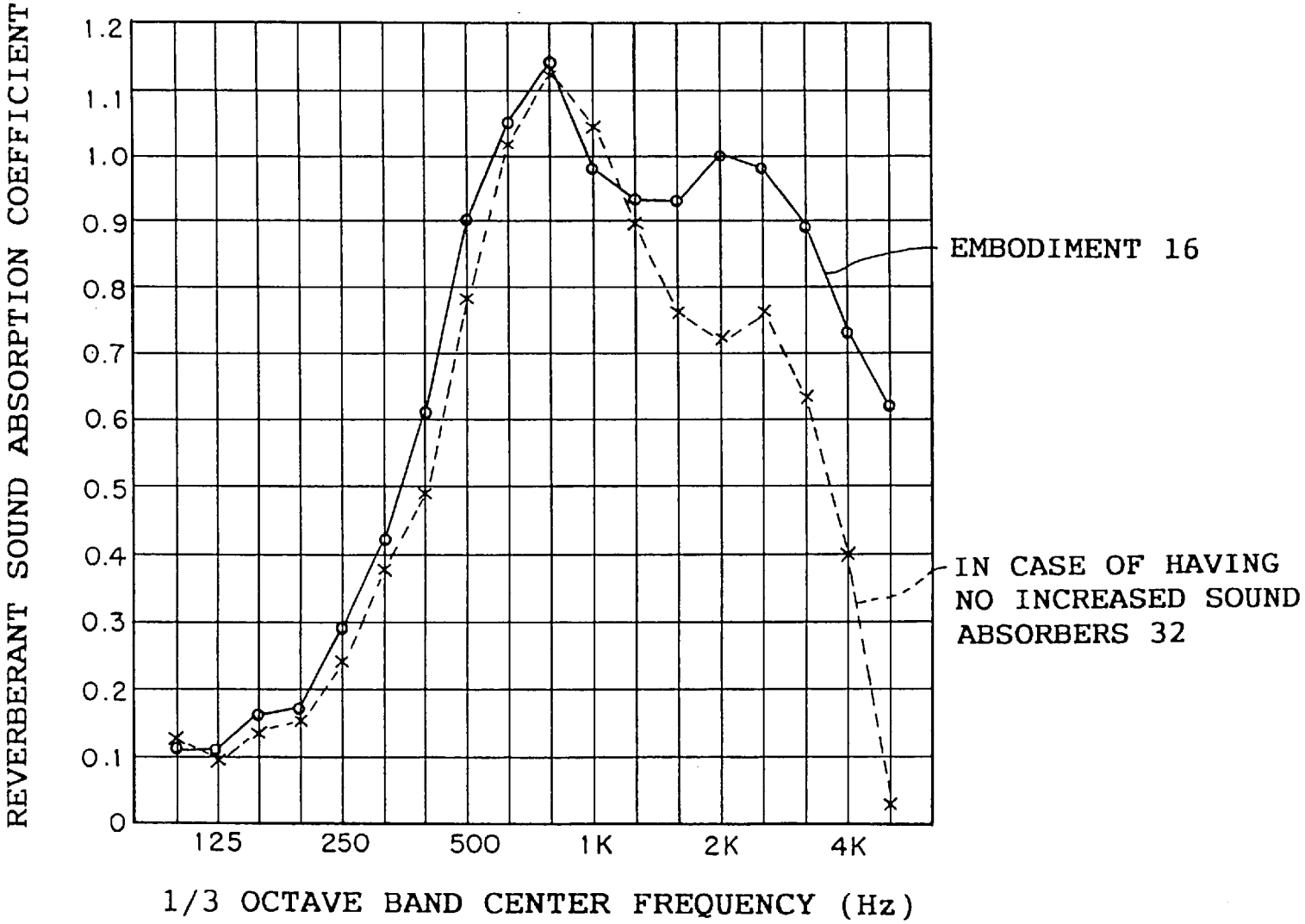
FIG. 34 is a sound absorption characteristic diagram of a sound absorbing mechanism using a porous material according to the embodiment 16 of the present invention in conformity with the method for measurement of sound absorption coefficients in a reverberation room.
Figure 35:
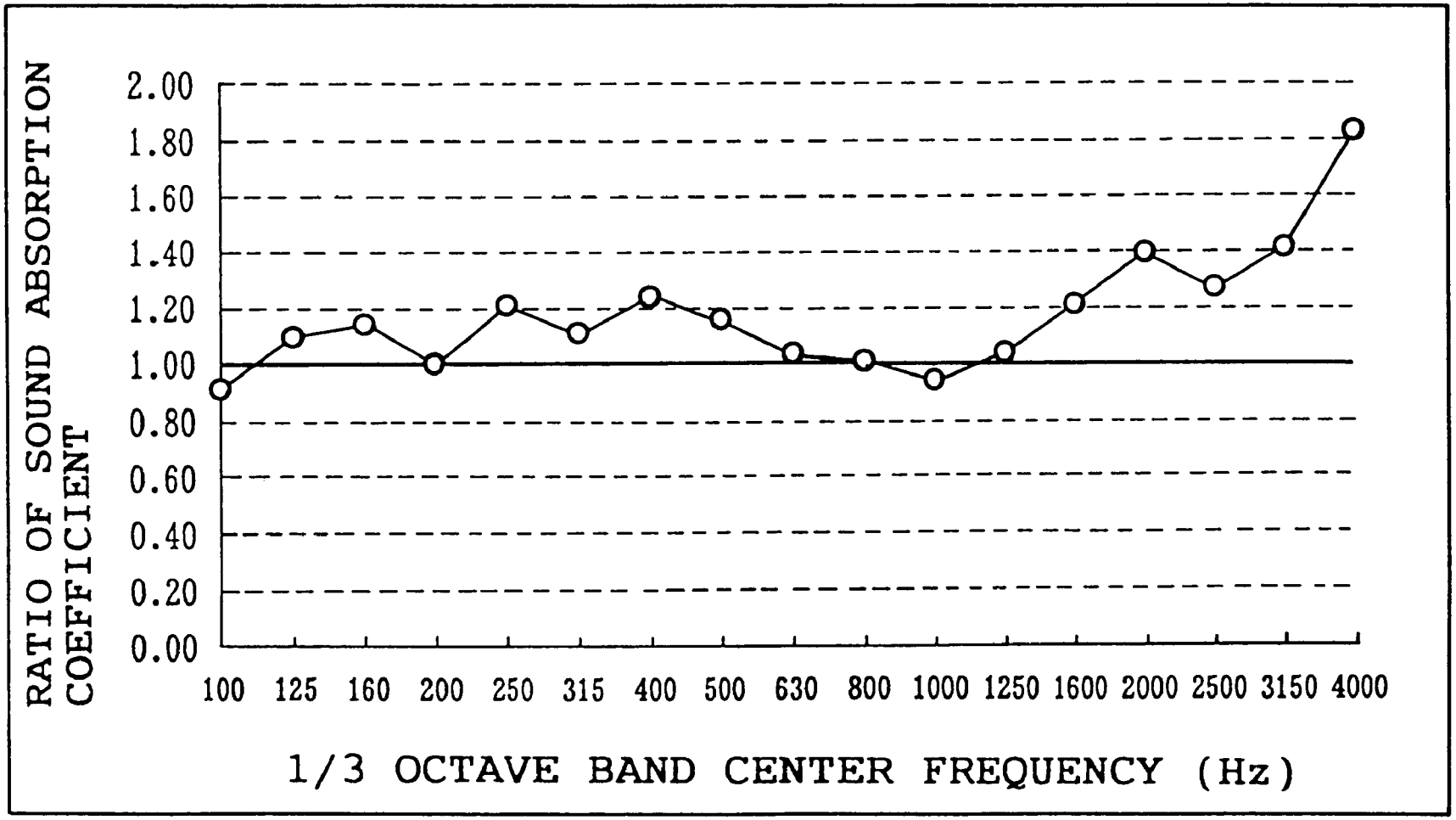
FIG. 35 is a characteristic diagram showing an effect of a sound absorbing mechanism using a porous material according to the embodiment 16 of the present invention.

FIG. 32 is a perspective view showing the construction of a sound absorbing mechanism using a porous material according to a sixteenth embodiment (embodiment 16) of the present invention; FIG. 33 is a longitudinal sectional view showing the sound absorbing mechanism using a porous material shown in FIG. 33; FIG. 34 is a sound absorption characteristic diagram in conformity with the method for measurement of sound absorption coefficients in a reverberation room; and FIG. 35 is a characteristic diagram showing the ratios of the sound absorption coefficients in the case where the sound absorbing mechanism shown in FIGS. 32 and 33 is equipped with the increased sound absorbers 32 to the sound absorption coefficients in the case where the sound absorbing mechanism is not equipped with the increased sound absorbers 32. In FIGS. 32 and 33, reference numeral 1 designates a sound insulator such as a wall. Reference numerals 3*a* and 3*b* designate sound absorbing plates using a hard thin plate porous material. The materials of the sound absorbing plates 3*a* and 3*b* are plastic particles, a ceramic, foam metal or the like. Reference numerals 11 and 12 designate back air spaces of the sound absorbing plate 3*a;* and numerals 11*a* and 12*a* designate the thicknesses of the back air spaces 11 and 12 respectively. Reference numeral 14 designates the back air spaces of the sound absorbing plates 3*b;* and numeral 14*a* designates the thickness of the perpendicular direction of the back air spaces 14. Reference numerals 20*a* and 20*b* designate latticed supporting members for supporting the sound absorbing plate 3*a* so as to be opposed to the sound insulator 1 above the sound insulator 1 with the space of the thickness 11*a* of the back air spaces 11. Reference numeral 30 designates resonators equipped to the sound insulator 1 side of the sound absorbing plate 3*a* with the space of the thickness 12*a* of the back air spaces 12; and numeral 30*a* designates hollow members for forming the resonators 30. The resonators 30 are disposed so as to be parallel to the supporting members 20*a* and perpendicular to the supporting members 20*b*. Reference numeral 32 designates plural increased sound absorbers composed of a sound absorbing plate 3*b* and a back air space 14 and disposed so as to be opposed to the top surface of the sound absorbing plate 3*a*. Reference numeral 81 designates an input sound into a back air space 11; numeral 81*b* designates a re-input sound into a back air space 12 which re-input sound 81*b* is the input sound 81 having been reflected by the sound absorbing plate 3*a* and an increased sound absorber 32; numeral 82 designates an input sound into a back air space 12; and numeral 82*b* designates a re-input sound into a back air space 11 which re-input sound 82*b* is the input sound 82 having been reflected by the sound absorbing plate 3*a* and an increased sound absorber 32. Reference numeral 84 designates an input sound into a back air space 14.

Next, the operation thereof will be described. Since the back air spaces 11 are separated by the supporting members 20*a* and 20*b* and the back air spaces 12 are separated by the hollow members 30*a* and the supporting members 20*b* respectively, each back air space 11 and each back air space 12 respectively operate independently as described in the embodiment 1, and thereby it becomes easy to generate resonance phenomena, which brings about the improvement of the sound absorption performance thereof. Since the interference of sound waves due to phase differences is thus little, the present sound absorbing mechanism has larger sound absorption coefficients as compared with those of the prior arts 1 and 2. The resonance frequency $f_0$ of the input sound 81 is determined mainly in accordance with the thickness 11*a* of the back air spaces 11. The resonance frequency $f_0$ of the input sound 84 is also determined mainly in accordance with the thickness 14*a* of the back air spaces 14. Sound absorption coefficients respectively become maximum at the resonance frequencies $f_0$ of them. Since each sound absorbing mechanism is independent of each other, the total sound absorption characteristic is the sum of the respective sound absorption characteristics. Furthermore, many sounds do not pass through the sound absorbing plate 3*a* but are reflected on the surface thereof in the case where the sound absorbing coefficient thereof is small. Accordingly, when the increased sound absorbers 32 are placed so as to be opposed to the sound absorbing plate 3*a,* the reflected sounds are reflected by the increased sound absorbers 42 again and are input into the sound absorbing plate 3*a* as the re-input sounds 81*b* and 82*b* to be absorbed by it. Because sounds having a shorter wavelength become re-input sounds 81*b* and 82*b* more efficiently, sound absorption coefficients at frequencies higher than the resonance frequency $f_0$ are increased, and thereby sound absorption coefficients can be improved from lower frequencies to higher frequencies as compared with those of the prior arts 1 to 3.

Because the re-input sounds have a propagation path longer than those of the input sounds, their phases are shifted. Consequently, resonance phenomena are reinforced at some frequencies, which brings about the increase of sound absorption coefficients.

Some sounds of the input sounds into the increased sound absorbers 32 are pulled into the spaces between the increased sound absorbers 32 owing to the phenomena such as diffraction. Because the impedance of them is matched and their input angles become close to be perpendicular, they are absorbed efficiently.

The sound absorbing mechanism uses a thin plate porous material as the sound absorbing plates 3*a* and 3*b,* which porous material is made by partially heating and welding plastic particles made from polypropylene resin, polyvinyl chloride resin, ABS resin, polycarbonate resin or the like, and is fully disclosed in Japanese Published Unexamined Patent Application of No. 289333/1990 (Tokkai-Hei 2-289333) titled "*Takoshitsu Kozotai* (*Porous Material*)". The sound absorbing plate 3*a* having the thickness of about 3.5 mm is fixed so that the thickness 11*a* of the back air spaces 11 becomes about 35 mm, and the hollow members 30*a* are fixed to the sound absorbing plate 3*a* so that the thickness 12*a* of the back air spaces 12 becomes about 9 mm for forming the resonators 30. The sound absorbing plates 3*b* having a thickness of about 3.5 mm are fixed so that the thicknesses 14*a* of the back air spaces 14 becomes about 10 mm. And then, the increased sound absorbers 32 thus constructed and sized to have the width of about 33 mm and the height of about 15 mm are disposed with a space of about 15 mm from the sound absorbing plate 3*a* so as to be perpendicular to the resonators 30. The sound absorption characteristic of the sound absorbing mechanism thus constructed is improved in sound absorption coefficients at frequencies higher than about 1.25 kilo-Hz and is totally improved at a wider frequency band as compared to the sound absorption characteristic in case of having no increased sound absorbers as shown in FIGS. 34 and 35. Since the sound absorbing plate 3*a* is supported by the supporting members 20*a* and 20*b*, the strength of the sound absorbing plate 3*a* is increased. According to the results of some experiments, sound absorption coefficients are furthermore improved at the thickness 12*a* of the back air space 12 being about 15 mm.

In FIGS. 32 and 33, the embodiment 16 has latticed supporting members 20*a* and 20*b*, but the present invention comprises the use of the supporting members 20*a* alone or the supporting members 20*b* alone. By such usage, the effects similar to those of the present embodiment can be expected. Similar effects also can be expected in the case where the increased sound absorbers 32 are disposed to be parallel to the resonators 30.

Embodiment 17

Figure 36:
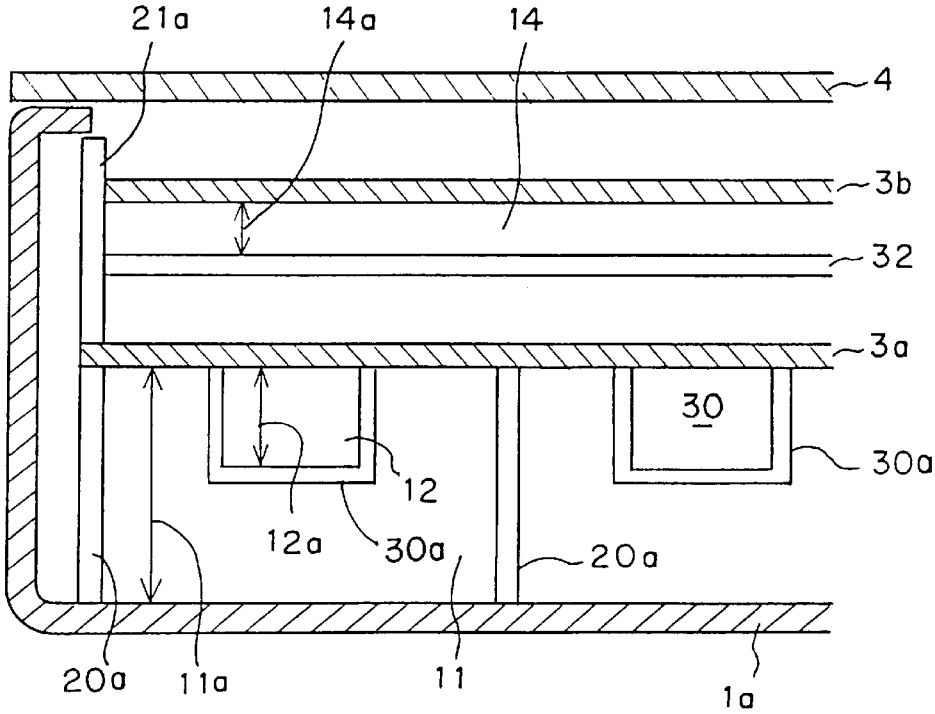
FIG. 36 is a longitudinal sectional view showing the construction of a sound absorbing panel using a porous material according to the embodiment 17 of the present invention.

FIG. 36 is a longitudinal sectional view showing the construction of a sound absorbing panel using a porous material according to a seventeenth embodiment (embodiment 17) of the present invention. In FIG. 36, reference numeral 1*a* designates a sound insulating plate also serving as a housing of the sound absorbing panel. Reference numeral 4 designates a protecting plate made of a punching metal or the like, which protecting plate 4 has at least one opening and is fixed to the insulating plate 1*a* so as to cover the opened part of the sound insulating plate 1*a*. Reference numeral 21*a* designates a supporting member for disposing the increased sound absorbers 32. The subject matter realized in the embodiment 16 brings about effects similar to those of the embodiment 16 even if it is applied to the form of a sound absorbing panel as shown in this embodiment.

Embodiment 18

Figure 37:
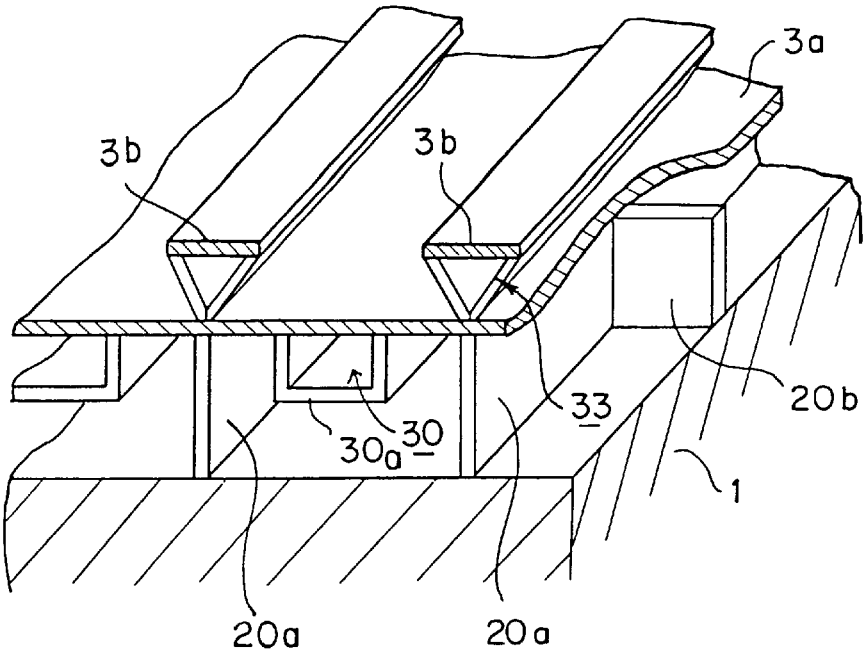
FIG. 37 is a perspective view showing the construction of a sound absorbing mechanism using a porous material according to the embodiment 18 of the present invention.
Figure 38:
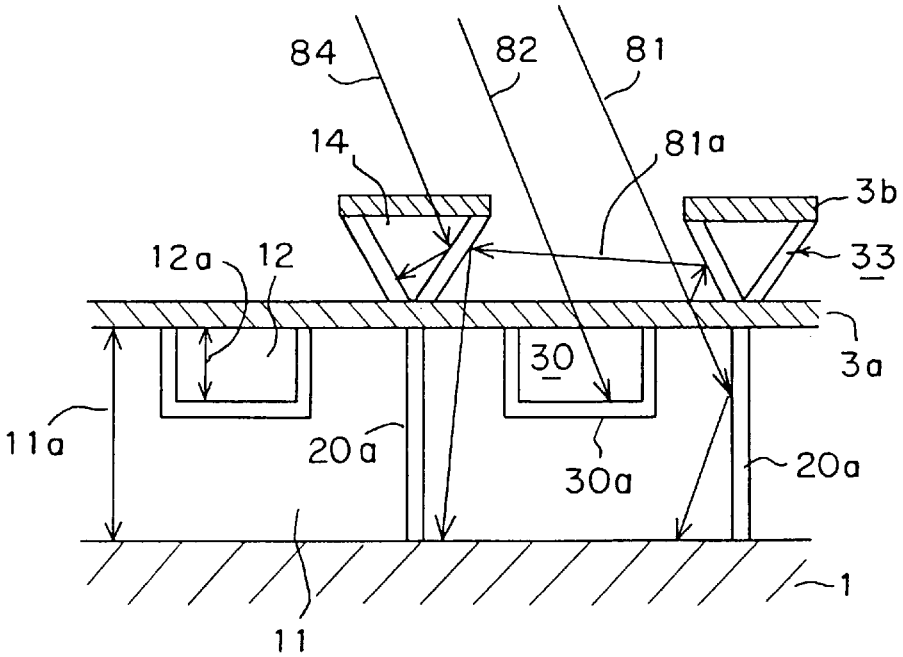
FIG. 38 is a longitudinal sectional view showing the construction of a sound absorbing mechanism using a porous material according to the embodiment 18 of the present invention.
Figure 39:
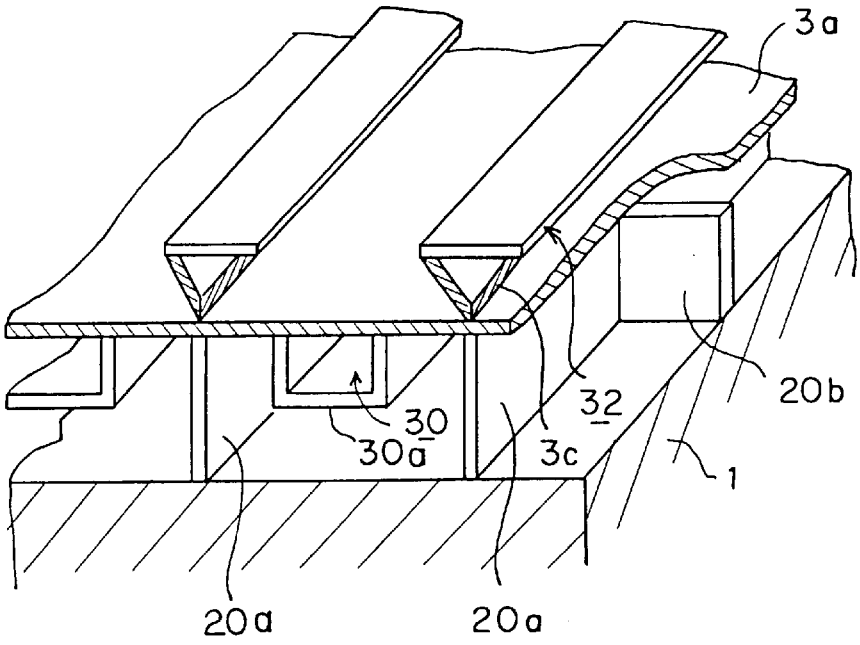
FIG. 39 is a perspective view showing the construction of a sound absorbing mechanism using a porous material according to the embodiment 18 of the present invention.
Figure 40:
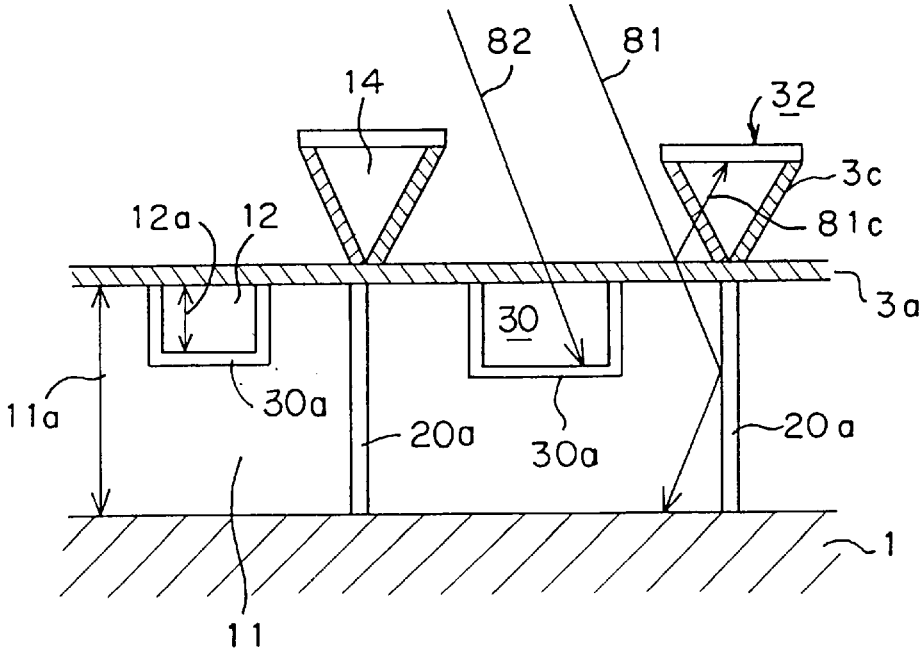
FIG. 40 is a longitudinal sectional view showing the construction of a sound absorbing mechanism using a porous material according to the embodiment 18 of the present invention.

FIGS. 37 and 39 are perspective views showing the constructions of sound absorbing mechanisms using porous materials according to an eighteenth embodiment (embodiment 18) of the present invention; and FIGS. 38 and 40 are longitudinal sectional views showing each sound absorbing mechanism shown in FIGS. 37 and 39 respectively. In FIGS. 37 to 40, reference numerals 3*b* and 3*c* designate sound absorbing plates using a thin plate porous material. The materials of the sound absorbing plates 3*b* and 3*c* are plastic particles, a ceramic, foam metal or the like. The sound absorbing plates 3*a* and 3*b* form the back air spaces 14 and increased sound absorbers 32 and are disposed so that the sound absorbing plate 3*a* is put between the sound absorbing plates 3*b* or 3*c* and the supporting members 20*a* or 20*b*. The increased sound absorbers 33 composed of a sound absorbing plate 3*b* and a back air space 14 are disposed so that the sound absorbing plate 3*a* is put between the increased sound absorbers 33 and the supporting members 20*a* or 20*b*. Reference numeral 81*a* designates a re-input sound into a back air space 11 which re-input sound 81*a* is the input sound 81 having been reflected by the sound absorbing plate 3*a* and an increased sound absorber 33. Reference numeral 81*c* designates a re-input sound into a back air space 14 which re-input sound 81*c* is the input sound 81 having been reflected by the sound absorbing plate 3*a*.

The thus constructed sound absorbing mechanism using a porous material has not only the effect of the improvement of sound absorption coefficients as described with respect to the embodiment 16 but also the effect of the increase of the strength of the sound absorbing plate 3*a*.

In FIGS. 37 to 40, the embodiment 18 has latticed supporting members 20*a* and 20*b*, but the present invention comprises the use of the supporting members 20*a* alone or the supporting members 20*b* alone. By such usage, the effects similar to those of the present embodiment can be expected.

Embodiment 19

Figure 41:
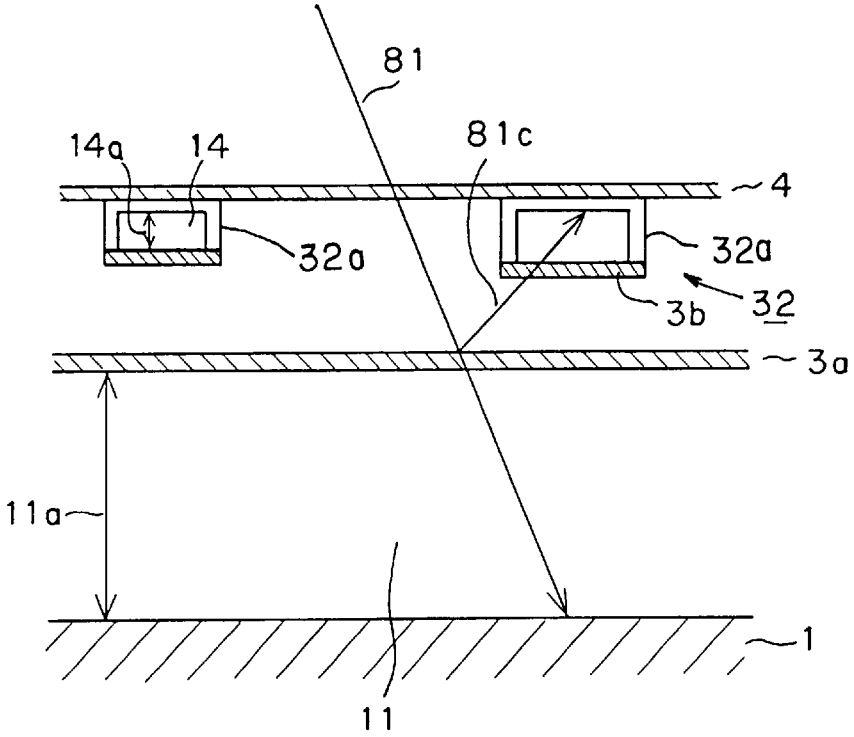
FIG. 41 is a longitudinal sectional view showing the construction of a sound absorbing mechanism using a porous material according to the embodiment 19 of the present invention.

FIG. 41 is a longitudinal sectional view showing the construction of a sound absorbing mechanism using a porous material according to a nineteenth embodiment (embodiment 19) of the present invention. In FIG. 41, reference numeral 1 designates a sound insulator such as a wall. Reference numerals 3*a* and 3*b* designate sound absorbing plates using a thin plate porous material. The materials of the sound absorbing plates 3*a* and 3*b* are plastic particles, a ceramic, foam metal or the like. Reference numeral 4 designates a protecting plate made of a punching metal or the like, which protecting plate 4 has at least one opening and is disposed so as to be opposed to the top surface of the sound absorbing plate 3*a*. Reference numeral 11 designates the back air space of the sound absorbing plate 3*a*; and numeral 11*a* designates the thickness of the back air space 11. Reference numeral 14 designates back air spaces of the sound absorbing plates 3*b*; and numeral 14*a* designates the thickness of the perpendicular direction of the back air space 14. Reference numeral 32 designates plural increased sound absorbers fixed to the protecting plate 4 and composed of a sound absorbing plate 3*b* and a back air space 14 and furthermore disposed so as to be opposed to the top surface of the sound absorbing plate 3*a*. Reference numeral 81 designates an input sound into the back air space 11; and numeral 81*c* designates a re-input sound into a back air space 14 which re-input sound 81*c* is the input sound 81 having been reflected by the sound absorbing plate 3*a*.

Since the sound absorbing mechanism using a porous material of the embodiment 19 is thus constructed, it can improve sound absorption coefficients at lower frequencies to higher frequencies similarly in the embodiment 14. And it can prevent the damage of the sound absorbing plate 3*a* by means of the protecting plate 4. Furthermore, since the increased sound absorbers 32 are fixed to the protecting plate 4 in advance, they serve also as reinforcements to the protecting plate 4 and the efficiency of fitting operation of the protecting plate 4 at fitting sites is high.

The sound absorbing plate 3*b* can be expected to have similar effects in case of being fixed perpendicularly to the protecting plate 4 as shown in FIG. 28.

Embodiment 20

Figure 42:
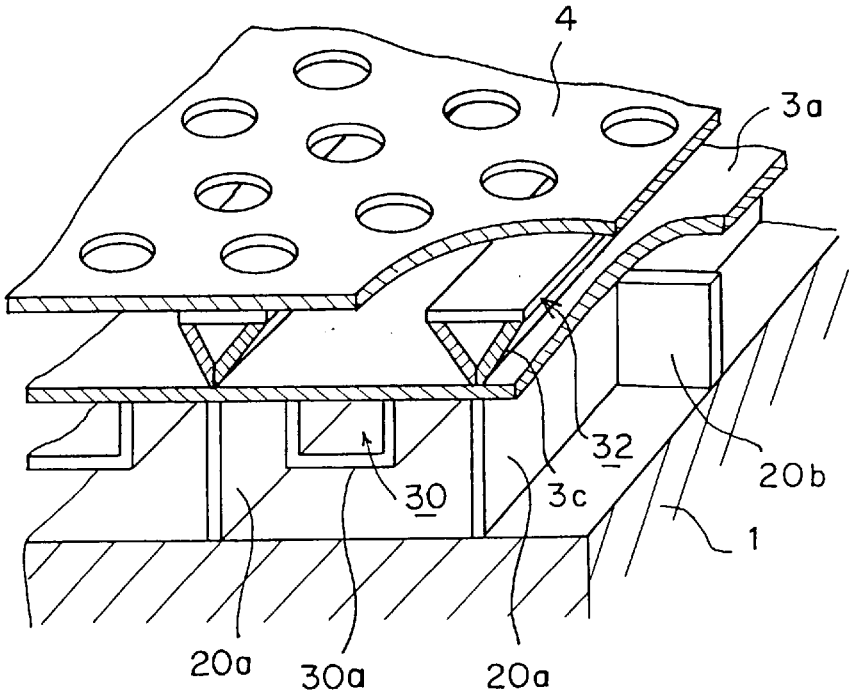
FIG. 42 is a perspective view showing the construction of a sound absorbing mechanism using a porous material according to the embodiment 20 of the present invention.
Figure 43:
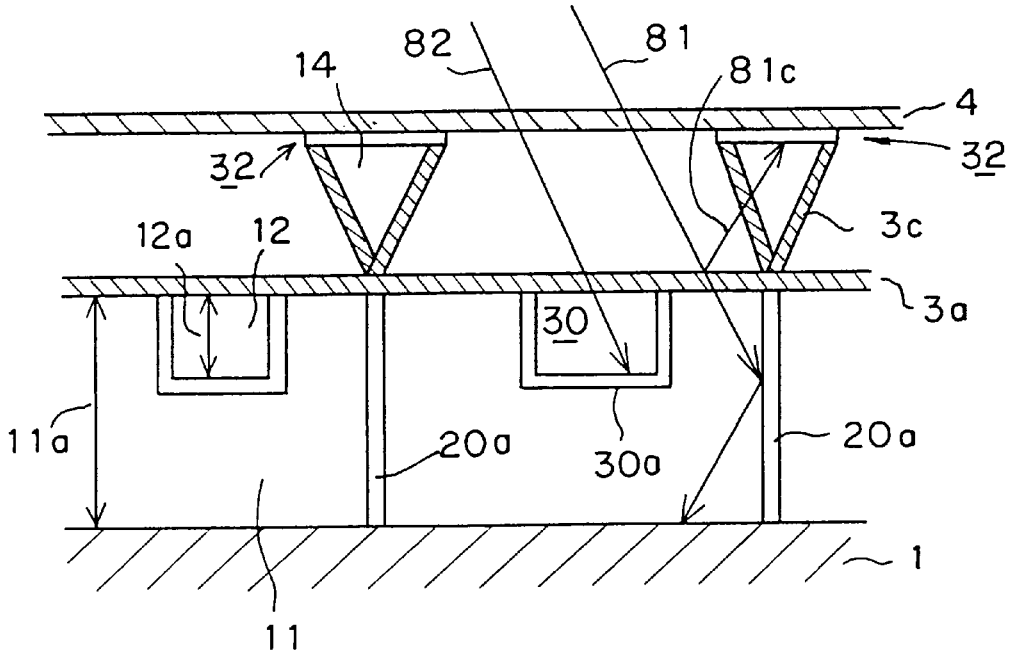
FIG. 43 is a longitudinal sectional view showing the construction of a sound absorbing mechanism using a porous material according to the embodiment 20 of the present invention.
Figure 44:
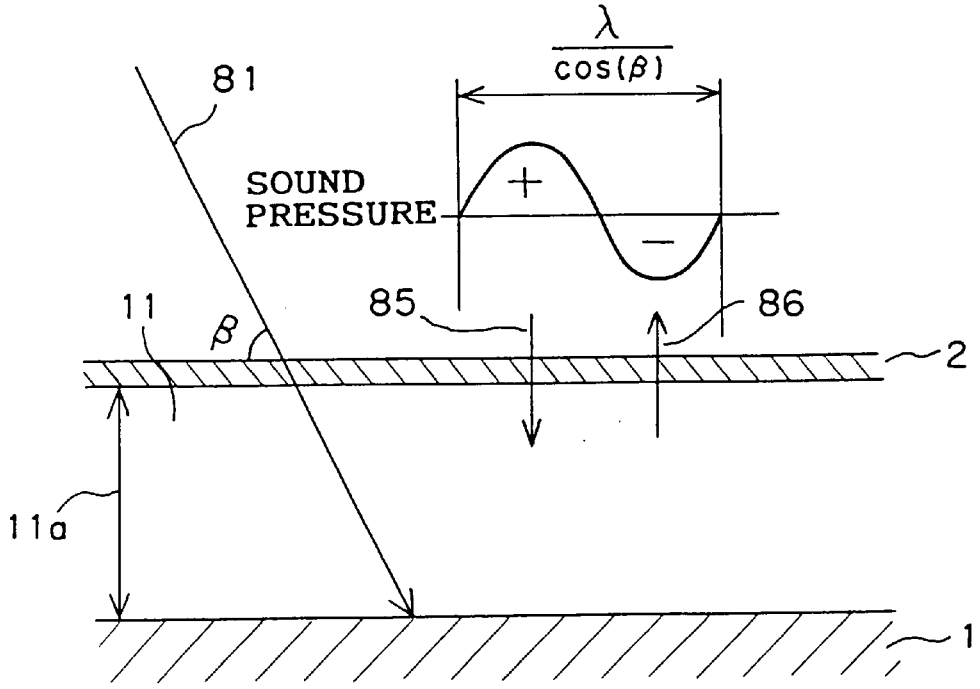
FIG. 44 (PRIOR ART)
FIG. 44 is a longitudinal sectional view showing the construction of a conventional sound absorbing mechanism using a porous material, including an explanatory diagram showing a sound pressure distribution of a sound wave to be input into the sound absorbing plate thereof.
Figure 45:
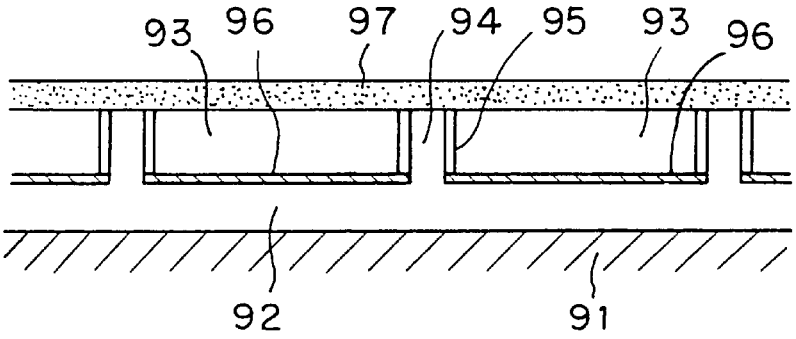
FIG. 45 (PRIOR ART)
FIG. 45 is a longitudinal sectional view showing the construction of a conventional sound absorbing mechanism utilizing a sound absorbing material and a resonance phenomenon by combining them.
Figure 46:
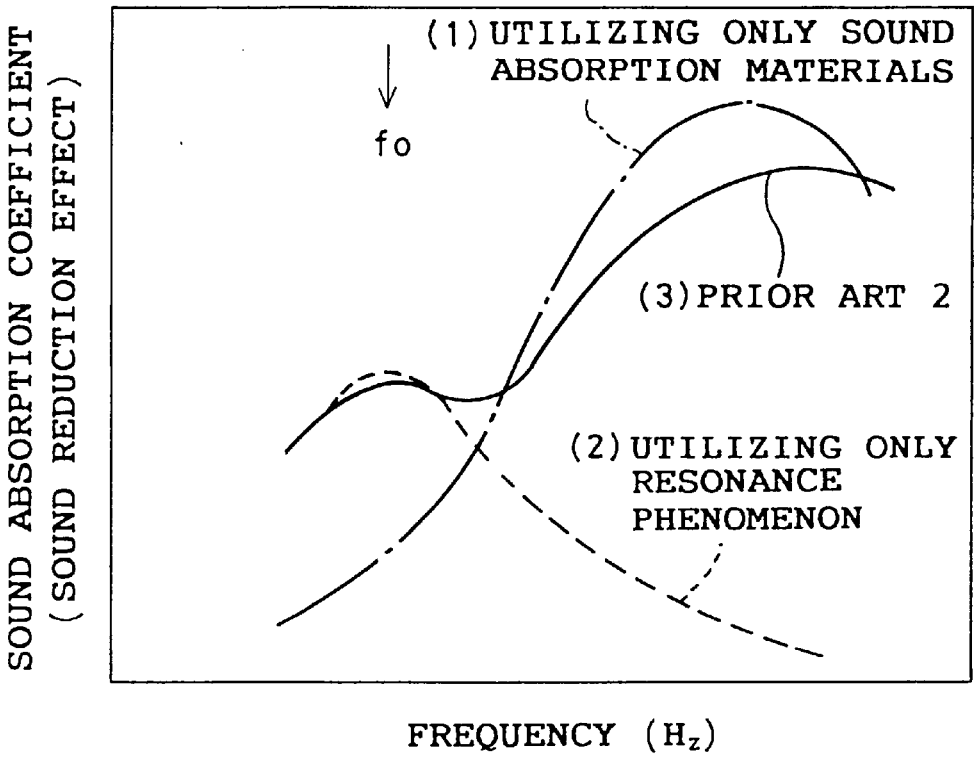
FIG. 46 (PRIOR ART)
FIG. 46 is a sound absorption characteristic diagram of the conventional sound absorbing mechanism utilizing a sound absorbing material and a resonance phenomenon by combining them.
Figure 47:
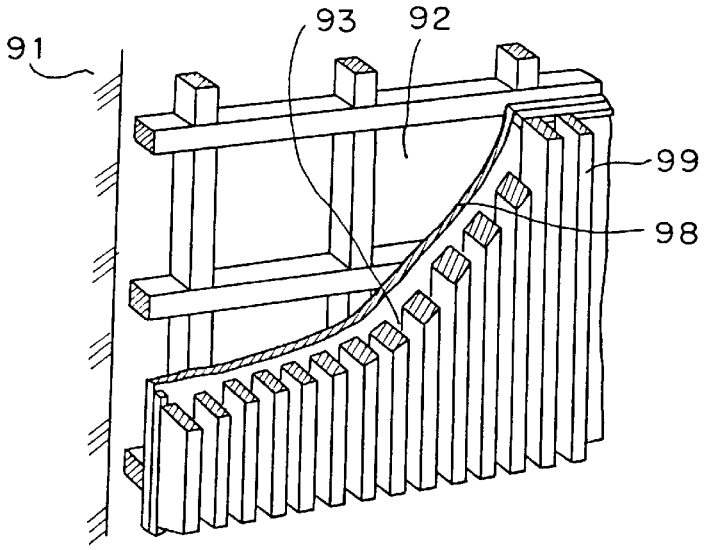
FIG. 47 (PRIOR ART)
FIG. 47 is a partially cutaway perspective view showing the construction of a conventional sound absorbing mechanism utilizing both slits and a porous material.
Figure 48:
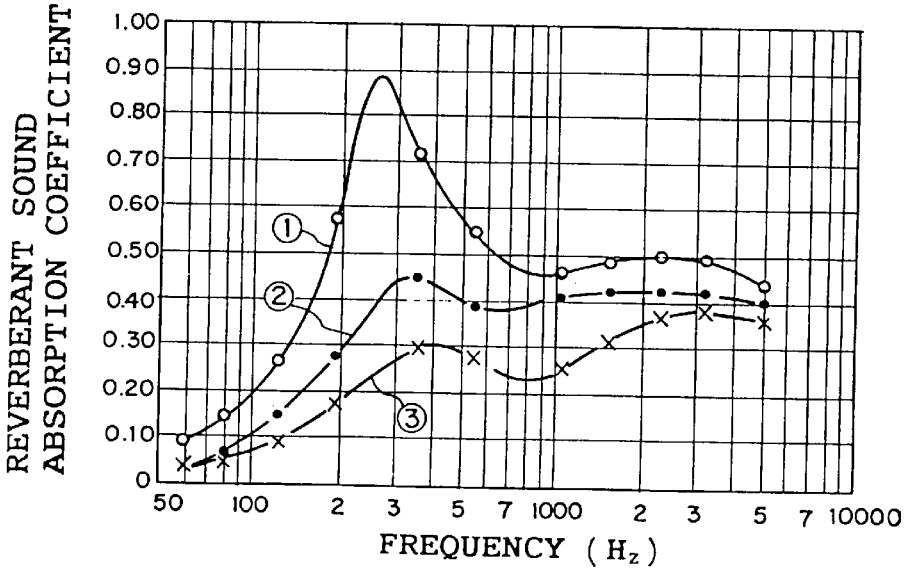
FIG. 48 (PRIOR ART)
FIG. 48 is a sound absorption characteristic diagram of the conventional sound absorbing mechanism utilizing both slits and a porous material.

FIG. 42 is a perspective view showing the construction of a sound absorbing mechanism using a porous material according to a twentieth embodiment (embodiment 20) of the present invention; and FIG. 43 is a longitudinal sectional view showing the sound absorbing mechanism using a porous material shown in FIG. 42. In FIGS. 42 and 43, reference numeral 1 designates a sound insulator such as a wall. Reference numerals 3*a* and 3*c* designate sound absorbing plates using a thin plate porous material similar to the sound absorbing plate 2 in the embodiment 1. The materials of the sound absorbing plates 3*a* and 3*c* are plastic particles, a ceramic, foam metal or the like. Reference numeral 4 designates a protecting plate made of a punching metal or the like, which protecting plate 4 has at least one opening and is disposed so as to be opposed to the top surface of the sound absorbing plate 3*a*. Reference numerals 11 and 12 designate back air spaces of the sound absorbing plate 3*a;* and numerals 11*a* and 12*a* designate the thicknesses of the back air space 11 and 12 respectively. Reference numeral 14 designates back air spaces of the sound absorbing plates 3*c*. Reference numerals 20*a* and 20*b* designate latticed supporting members disposed so that the sound absorbing plate 3*a* is opposed to the sound insulator 1 with the space of the thickness 11*a* of the back air space 11. Reference numeral 30 designates resonators fixed to the insulator 1 side of the sound absorbing plate 3*a* with the space of the thickness 12*a* of the back air spaces 12; and numeral 30*a* designates hollow members for forming the resonators 30. The resonators 30 are disposed so as to be parallel to the supporting members 20*a* and perpendicular to the supporting members 20*b*. Reference numeral 32 designates plural increased sound absorbers fixed to the protecting plate 4 and composed of a sound absorbing plate 3*c* and a back air space 14. The increased sound absorbers 32 are disposed so that the sound absorbing plate 3*a* is put between the increased sound absorbers 32 and the supporting members 20*a* or 20*b*. Reference numeral 81 designates an input sound into a back air space 11; numeral 81*c* designates a re-input sound into a back air space 14 which re-input sound 81*c* is the input sound 81 having been reflected by the sound absorbing plate 3*a;* and numeral 82 designates an input sound into a back air space 12.

Next, the operation thereof will be described. Since the sound absorbing mechanism using a porous material of the embodiment 20 is thus constructed, it can improve sound absorption coefficients at lower frequencies to higher frequencies as described in the embodiment 18. And it can prevent the damage of the sound absorbing plate 3*a* by means of the protecting plate 4. Furthermore, since the increased sound absorbers 32 are fixed to the protecting plate 4 in advance, they serve also as reinforcements to the protecting plate 4 and the efficiency of fitting operation of the protecting plate 4 at fitting sites is high. The strength of the sound absorbing plate 3*a* is also increased by the sound absorbers 32.

In FIGS. 42 and 43, the embodiment 20 has latticed supporting members 20*a* and 20*b,* but the present invention comprises the use of the supporting members 20*a* alone or the supporting members 20*b* alone. By such usage, a part of the effects of the present embodiment can be obtained.

It will be appreciated from the foregoing description that, according to the first aspect of the present invention, the sound absorbing mechanism is constructed so as to support a sound absorbing plate above a sound insulator, to form first separated plural back air spaces by separating a space between the sound absorbing plate and the sound insulator, and to form a first resonator having a second back air space separated from the first back air space in each first back air space, and consequently, the sound absorbing mechanism which has a superior sound absorption characteristic from lower frequencies to higher frequencies can be obtained.

Furthermore, according to the second aspect of the present invention, the sound absorbing mechanism is constructed so as to comprise plural reflecting members disposed with a space from the sound absorbing plate, and consequently, the sound absorbing mechanism which has a superior sound absorption characteristic from lower frequencies to higher frequencies can be obtained.

Furthermore, according to the third aspect of the present invention, the sound absorbing mechanism is constructed so as to comprise plural reflecting members disposed in front of a sound absorbing plate with a space from the sound absorbing plate, and a protecting plate disposed in front of the reflecting members for fixing the reflecting members which protecting plate has an opening, and consequently, the sound absorbing mechanism which has a superior sound absorption characteristic from lower frequencies to higher frequencies can be obtained.

Furthermore, according to the fourth aspect of the present invention, the sound absorbing mechanism is constructed so as to comprise plural sound absorbers composed of a thin plate of a porous material and a second hollow member, which sound absorbers are disposed in front of a sound absorbing plate, and consequently, the sound absorbing mechanism which has a superior sound absorption characteristic from lower frequencies to higher frequencies can be obtained.

Furthermore, according to the fifth aspect of the present invention, the sound absorbing mechanism is constructed so as to comprise plural sound absorbers composed of a thin plate of a porous material and a second hollow member, which sound absorbers are disposed in front of a sound absorbing plate, and a protecting plate disposed in front of the sound absorbers, which protecting plate has an opening, and consequently, the sound absorbing mechanism which has a superior sound absorption characteristic from lower frequencies to higher frequencies can be obtained.

Furthermore, according to the sixth aspect of the present invention, the sound absorbing mechanism is constructed so as to comprise a sound absorbing plate and plural reflecting members disposed in front of the sound absorbing plate with a space from the sound absorbing plate, and consequently, the sound absorbing mechanism which has a superior sound absorption characteristic from lower frequencies to higher frequencies can be obtained.

Furthermore, according to the seventh aspect of the present invention, the sound absorbing mechanism is constructed so as to comprise a protecting plate disposed in front of reflecting members, which protecting plate has an opening, and consequently, the sound absorbing mechanism which has a superior sound absorption characteristic from lower frequencies to higher frequencies can be obtained.

Furthermore, according to the eighth aspect of the present invention, the sound absorbing mechanism is constructed so as to comprise a sound absorbing plate made of a thin plate of a porous material, and sound absorbers composed of a thin plate of a porous material and a hollow member, which sound absorbers are disposed in front of the sound absorbing plate with a space from the sound absorbing plate, and consequently, the sound absorbing mechanism which has a superior sound absorption characteristic from lower frequencies to higher frequencies can be obtained.

Furthermore, according to the ninth aspect of the invention, the sound absorbing mechanism is constructed so as to comprise a protecting plate disposed in front of plural sound absorbers for fixing the sound absorbers, which protecting plate has an opening, and consequently, the sound absorbing mechanism which has a superior sound absorption characteristic from lower frequencies to higher frequencies can be obtained.

Furthermore, according to the tenth aspect of the present invention, the sound absorbing mechanism is constructed so that the sound absorbing plate thereof is made by welding plastic particles partially, and consequently, the sound absorbing mechanism which has a superior sound absorption characteristic from lower frequencies to higher frequencies can be obtained.

Furthermore, according to the eleventh aspect of the present invention, the sound absorbing mechanism is constructed so as to be a sound absorbing panel by equipping a sound insulating plate at the back of a sound absorbing mechanism, and consequently, the sound absorbing mechanism which has a superior sound absorption characteristic from lower frequencies to higher frequencies can be obtained.

Furthermore, according to the twelfth aspect of the present invention, the sound absorbing mechanism is constructed so as to comprise third hollow members for forming second resonators having a third back air space, and consequently, the sound absorbing mechanism which has a superior sound absorption characteristic from lower frequencies to higher frequencies can be obtained.

While preferred embodiments of the present invention have been described using specific terms, such description is for illustrative purposes only, and it is to be understood that changes and variations may be made without departing from the spirit or scope of the following claims.

What is claimed is:

1. A sound absorbing mechanism using a porous material to be placed on a sound insulator comprising:

a sound absorbing plate made of a thin plate of a porous material;

supporting members for supporting said sound absorbing plate above said sound insulator, the supporting members forming separated plural first back air spaces by defining a space between said sound absorbing plate and said sound insulator; and first hollow members placed on a back of said sound absorbing plate within each said first back air space for forming first resonators defining second back air spaces separated and independent from said first back air spaces wherein an air gap is maintained between said first hollow members and said sound insulator such that said first hollow member is not in contact with said sound insulator and wherein each first back air space has a substantially U-shape, defined by said sound absorbing plate, said sound insulator, said supporting members, said first hollow members and said air gap.

2. The sound absorbing mechanism using a porous material according to claim 1, which further comprises plural reflecting members disposed in front of said sound absorbing plate with a space from the sound absorbing plate.

3. The sound absorbing mechanism using a porous material according to claim 1, which further comprises:

plural reflecting members disposed in front of said sound absorbing plate with a space from the sound absorbing plate; and a protecting plate disposed in front of said reflecting members for fixing the reflecting members, the protecting plate having an opening.

4. The sound absorbing mechanism using a porous material according to claim 1, which further comprises plural sound absorbers composed of a thin plate of a porous material and a second hollow member, the sound absorbers being disposed in front of said sound absorbing plate with a space from the sound absorbing plate.

5. The sound absorbing mechanism using a porous material according to claim 1, which further comprises:

plural sound absorbers composed of a thin plate of a porous material and a second hollow member, the sound absorbers being disposed in front of said sound absorbing plate with a space from the sound absorbing plate; and a protecting plate disposed in front of said sound absorbers for fixing the sound absorbers, said protecting plate having an opening.

6. The sound absorbing mechanism using a porous material according to claim 1, wherein said sound absorbing plate is made by welding plastic particles partially.

7. The sound absorbing mechanism using a porous material according to claim 1, which is formed as a sound absorbing panel by equipping a sound insulating plate corresponding to said sound insulator at a back of a sound absorbing mechanism.

8. The sound absorbing mechanism using a porous material according to claim 1, which further comprises a third hollow member fixed to a back of said sound absorbing plate for forming a second resonator having a third back air space separated from said second back air space in each inside of said first hollow members.

9. The sound absorbing mechanism using a porous material according to claim 1, wherein said first hollow members comprise two parallel elongated walls each connected along an elongated side to said sound absorbing plate; and a floor connected between said two parallel elongated walls along another elongated side thereof, wherein said first hollow members form a rectangular protrusion into said first air spaces, creating the substantially U-shaped first air spaces.

* * * * *